US011425507B2

(12) United States Patent
Chou et al.

(10) Patent No.: US 11,425,507 B2
(45) Date of Patent: Aug. 23, 2022

(54) HIGH VOLUME MANUFACTURING OF MICRO ELECTROSTATIC TRANSDUCERS

(71) Applicant: GRAPHAUDIO INC., Beverly Hills, CA (US)

(72) Inventors: Harry Chou, Austin, TX (US); Jeff Maag, Belmont, CA (US); Burt Fowler, Buda, TX (US); Lorance Wilson, San Jose, CA (US)

(73) Assignee: GRAPHAUDIO INC., Beverly Hills, CA (US)

( * ) Notice: Subject to any disclaimer, the term of this patent is extended or adjusted under 35 U.S.C. 154(b) by 0 days.

(21) Appl. No.: 17/266,928

(22) PCT Filed: Aug. 7, 2019

(86) PCT No.: PCT/US2019/045486

§ 371 (c)(1),
(2) Date: Feb. 8, 2021

(87) PCT Pub. No.: WO2020/033534

PCT Pub. Date: Feb. 13, 2020

(65) Prior Publication Data

US 2021/0297788 A1 Sep. 23, 2021

Related U.S. Application Data

(60) Provisional application No. 62/716,062, filed on Aug. 8, 2018.

(51) Int. Cl.

| | |
|---|---|
| ***H04R 19/00*** | (2006.01) |
| ***H04R 19/02*** | (2006.01) |
| ***H04R 19/04*** | (2006.01) |

(52) U.S. Cl.
CPC ..... *H04R 19/02* (2013.01); *H04R 19/04* (2013.01)

(58) Field of Classification Search
CPC ..... H04R 19/005; H04R 19/03; H04R 19/05; H04R 2201/003; B81C 1/00214
See application file for complete search history.

(56) References Cited

U.S. PATENT DOCUMENTS 5,388,163 A * 2/1995 Elko ..... H04R 19/016 381/116
7,835,532 B2 * 11/2010 Yonehara ..... H04R 19/04 381/150

(Continued)

FOREIGN PATENT DOCUMENTS

CN 205040015 U 2/2016
CN 107246909 A 10/2017

OTHER PUBLICATIONS

International Search Report, PCT/US2019/045486, dated Oct. 28, 2019, 1 pg.

(Continued)

*Primary Examiner* — Ryan Robinson
(74) *Attorney, Agent, or Firm* — Paul D. Strain, Esq.; Strain & Strain PLLC

(57) ABSTRACT

Described are micro electrostatic transducers and methods of making such devices. The micro electrostatic transducer is an integrated component transducing device fabricated from materials allowing for low cost, high volume manufacturing. The device includes a sheet of graphene forming the diaphragm with two electrode layers above and below the diaphragm to introduce the audio signal.

24 Claims, 25 Drawing Sheets

(56) References Cited

U.S. PATENT DOCUMENTS

| | | | | |
|---|---|---|---|---|
| 9,154,886 | B2 * | 10/2015 | Chen | G01D 5/2417 |
| 9,391,541 | B2 * | 7/2016 | Cohen | H04R 3/12 |
| 9,516,428 | B2 | 12/2016 | Dehe et al. | |
| 10,986,435 | B2 * | 4/2021 | Murarka | H04R 1/1091 |
| 2007/0189556 | A1 * | 8/2007 | Tsuchiya | H04R 31/006 381/174 |
| 2008/0013761 | A1 | 1/2008 | Matsuzawa et al. | |
| 2015/0002061 | A1 | 1/2015 | Hatakeyama et al. | |
| 2015/0076632 | A9 | 3/2015 | Murarka et al. | |
| 2017/0289702 | A1 | 10/2017 | Inoue | |
| 2018/0066980 | A1 | 3/2018 | Zhou et al. | |

OTHER PUBLICATIONS

Zhou & Zettl et al., Electrostatic Graphene Loudspeaker, Applied Physics Letters vol. 102, 223109 (2013); https://doi.Org/10.1063/1.4806974.

* cited by examiner

HIGH VOLUME MANUFACTURING OF MICRO ELECTROSTATIC TRANSDUCERS

INCORPORATION BY REFERENCE OF RELATED PATENT APPLICATIONS

This application is a National Stage of International Application No. PCT/US2019/045486 filed Aug. 7, 2019, which is based upon and claims priority under 35 U.S.C. § 119(e) to U.S. provisional application U.S. Ser. No. 62/716,062 filed Aug. 8, 2018, the entire contents of all of which are incorporated herein by reference in their entirety.

BACKGROUND

The application relates to micro electrostatic transducers, arrays of such transducers, and methods of making such devices. An exemplary embodiment of the micro electrostatic transducer is an integrated component transducing device fabricated from materials allowing for low cost, high volume manufacturing, including: a sheet of graphene to form the diaphragm; a first spacer that is in large round, sheet, or roll format with patterning for many devices onto which one side of the graphene diaphragm is bonded; a first electrode proximate to one side of the graphene diaphragm and the first spacer; a second spacer with similar format bonded to the other side of the graphene diaphragm; and a second electrode proximate the other side of the graphene diaphragm and the second spacer. The first and second spacer both include substantially circular, square, elliptical, kidney, star, n-polygonal, etc. open regions that define a substantially circular portion above and below the graphene diaphragm. The device also has a first electrode that is in a large round, sheet, or roll format with patterning for many devices. The first electrode is proximate to one side of the circular portion of the graphene diaphragm and the first spacer. The device also has a second electrode in the same format proximate the other side of the circular portion of the graphene diaphragm and the second spacer. The device has patterned, electrically-conductive interconnects to an external acoustic electrical signal. There are three total interconnects, two for each of the two electrodes and one connected around the entire circumference of the diaphragm. The device further has electrical circuits connected to the electrode and diaphragm interconnects having the capability for signal sensing (current, voltage, capacitance), so that the device can function as a microphone, and also for applying audio or ultrasonic signals to the electrodes to modulate the diaphragm and emit acoustic waves so that the device can function as a speaker.

An exemplary embodiment of an array of such transducers includes a plurality of electrostatic transducers that are electrically connected and function as either a mono-speaker or large area microphone. In another exemplary embodiment, a plurality of electrostatic transducers are electrically connected such that individual or clusters of speakers can be multiplexed and used as different speaker channels and microphones simultaneously. In yet a further exemplary embodiment, the plurality of electrostatic transducers may be diced during manufacturing, e.g. individually or singulated to produce die portions having multiple electrostatic transducers per die.

An exemplary embodiment of a method of making the micro electrostatic transducer includes providing a first multilayer construction comprising first electrode and first spacer component, a diaphragm comprising a 2-D (two-dimensional) material, and a second multilayer construction comprising second electrode and second spacer component, subsequently aligning and attaching the diaphragm to the first multilayer construction using a first adhesive, and, lastly, aligning and attaching the second multilayer construction to the diaphragm using a second adhesive. Optionally, at least the first adhesive or the second adhesive permits an electric current to cross the adhesive and pass to the diaphragm. In a preferred embodiment, the 2-D material comprises graphene.

Electrostatic transducer technology is well established and has been used in many high-end audio products such as speakers and microphones. Scaling or shrinking these transducers to either a "mini" or "micro" format has been difficult because electrostatic transducer audio capabilities are tied to the effectiveness of air dampening. In particular, this is because the air damping coefficient significantly decreases when the size of the diaphragm falls below the sound wavelength. The only way to make a mini or micro-sized transducer with acceptable performance is to make the diaphragm thinner and lighter, but this solution has not been possible with traditional materials. However, with the recent invention at LBNL (Appl. Phys. Lett. 102, 223109 (2013); https://doi.org/10.1063/1.4806974) where the ultra-low mass and high strength graphene films were used, it has now become possible to fabricate much smaller format transducers while maintaining wide-band audio response.

In particular, electrostatic transducers using such graphene films perform better than current generation materials. For example, FIG. 1 shows the performance of a commercially available STAX SRS-002 electrostatic ear-speaker using a standard metalized polymer film as the diaphragm compared to the same transducer except that a low-mass graphene diaphragm was inserted into the transducer to replace the standard diaphragm. The improvement in low-frequency response is significant when using the graphene diaphragm.

Additionally, there are many opportunities for high quality/ value priced micro speakers and microphones, therefore a cost-effective way to manufacture them is very important. Like many other components that make up our electronic products such as logic/memory chips, power chips, wifi chips, antennas, flexible circuit boards, discrete devices, and connectors, they need to be produced in high volume with low cost. Now that mini/micro electrostatic transducers are feasible for such products, low cost/high volume methods to manufacture them are essential.

SUMMARY OF PREFERRED EMBODIMENTS

It is therefore one object of the application to provide a high-quality transducing device which can be manufactured in high volume with low cost and has a comparable response profile to current generation electrostatic transducers, for example as shown in FIG. 1. An exemplary embodiment of such a transducing device includes a diaphragm comprising a 2-D material. The exemplary device may have a first spacer that is in large round, sheet, or roll form having patterning for many devices onto which one side of the graphene diaphragm is bonded. The exemplary device may also have a second spacer that is in large round, sheet, or roll form having patterning for many devices, which is bonded to the other side of the graphene diaphragm, wherein the first and second spacer both bound substantially circular open regions that define a substantially circular portion above and below the graphene diaphragm. The exemplary device has a first electrode that is in a large round, sheet or roll format with patterning for many devices, which is proximate one side of the circular portion of the graphene diaphragm and the first spacer. The exemplary device has a second electrode that is in a large round, sheet or roll format with patterning for many devices, which is proximate the other side of the circular portion of the graphene diaphragm and the second spacer.

In a preferred embodiment, the 2-D diaphragm material is an atomically single or multilayer graphene film (up to thousands of layers of graphene). In another preferred embodiment, the diaphragm is selected from the group consisting of h-BN, $MoS_2$, and a bilayer film comprising the 2-D graphene diaphragm material and h-BN, $MoS_2$, or another single or multilayer 2-D film.

In another embodiment, the transducing device has an acrylic, polyester, silicone, polyurethane, halogenated plastic layer or photoresist, such as polyimide or epoxy-based polymers, such as SU-8 or PMMA formed on one or both sides of the graphene diaphragm to substantially cover the graphene surface. Other films such Silicon Dioxide, Aluminum Oxide, Silicon Nitride and Diamond and or Diamond-like films covering one or both sides are also possible. Such a layer can optionally be continuous to cover the entire graphene surface or patterned and removed from specified regions of the graphene surface. In either case, either as continuous or patterned, the intent would be either to strengthen the film over the entire surface or only in key areas, and/or provide tuning for the diaphragm to help suppress resonance peaks. In one scenario, the patterning could be such that it remains only along an outer perimeter of the diaphragm to provide additional mechanical strength in the regions where the diaphragm is rigidly clamped along the perimeter. In another scenario, the patterning could be such that the film is removed from the edge and left in the center region as a means to dampen or tune the diaphragm.

In still another embodiment, transducing device has a photo-active layer, or photoresist, such as a Novolac, epoxy-based polymers, such as SU-8, or PMMA material; formed on one or both sides of the graphene diaphragm to substantially cover the graphene surface. The layer can be selectively removed in any desired pattern to tune, enhance or modulate the diaphragm excursion profile in response to applied electrostatic forces, and/or to improve the film impact resistance and durability. In still another embodiment, the photoactive layer is optionally formed on one or both sides of the graphene diaphragm to blanket cover the graphene surface. Accordingly, both the photoresist layer and the graphene can be selectively removed in any desired pattern to tune, enhance or modulate the diaphragm's excursion profile in response to applied electrostatic forces; or to provide a ventilation flow path to prevent micro contamination build up and/or to further control the airflow due to the motion of the diaphragm and reduce phase cancellation (destructive interference) of the pressure waves. In the latter case, selective removal of graphene in some regions to form a desired pattern of holes in the graphene diaphragm utilizes a patterning step done by a technique such as photolithography, shadow-mask, lift-off, ink-jet printing, 3D-printing, or screen-printing. The patterning step is followed by the removal step where graphene is removed by ion etching or solution etching.

In a preferred embodiment, the transducing device includes a plurality of patterned electrically conductive interconnects to external acoustic electrical signal comprising one lead for each of the first and second electrodes and one lead arranged on a part of or around the entire circumference of diaphragm. This embodiment may have electrical circuitry connected to the plurality of patterned electrically conductive components, thus having the capability for signal sensing or for applying audio or ultrasonic signals to the electrodes to modulate the diaphragm and emit acoustic waves.

In a preferred embodiment, the diaphragm has open active transducer areas on both sides of the diaphragm, wherein the open active transducer areas are of circular, square, elliptical, kidney, star, n-polygonal, etc. shape.

In yet other embodiments, the transducer operates at the following gap distances and voltages: (1) a diaphragm to electrode gap between approximately 0.1 mm and approximately 1 mm, inclusive of the endpoints; (2) a $V_{DC}$ on the diaphragm of between approximately 20V and approximately 4 kV, inclusive of the endpoints; and (3) a $V_{signal}$ on the first and second electrodes of $V_{RMS}$ between approximately 20V and approximately 4 kV, inclusive of the endpoints.

In still another preferred embodiment, the transducer has in-plane layered device contacts electrically connected to pre-routed electrode or spacer components.

Another object of the present application is to provide a manufacturing method such that high volumes of high quality "micro" transducing devices can be manufactured at low cost for use in transducer arrays having a comparable or superior response profile to current-generation, larger-format electrostatic transducers that use traditional diaphragm materials. In particular, most current-generation transducing devices still require a hybrid approach utilizing a traditional dynamic speaker to achieve acceptable bass response, whereas the transducing devices of the present application exhibit substantial improvement in low-frequency bass response when using a graphene diaphragm in addition to matching or exceeding response for current-generation devices in other portions of the audible range. The arrays can be formed at least from the devices of the exemplary embodiments but should not be considered to be limited to such embodiments. Such arrays can be optionally arranged in a custom array or an as-fabricated contiguous multiplex array of devices.

In one exemplary embodiment of such an array, a plurality of electrostatic transducers are electrically connected and function as either a mono-speaker or large area microphone. In another exemplary embodiment, a plurality of electrostatic transducers are electrically connected such that individual or clusters of speakers can be multiplexed and used as different speaker channels and microphones simultaneously.

As yield issues for a new technology could impact viability of directly manufacturing in array configurations, often it is more prudent to singulate devices and utilize packaging methods to produce transducer arrays. As graphene production methods improve and yields increase, then other methods such as single carve outs of non-functioning devices and drop in replacements may be possible. Additionally, sort and test methods could optimize singulation methods to groups or blocks of functioning transducers for direct use or further packaging.

Accordingly, in one embodiment, a method for producing an electrostatic transducer includes providing a first multilayer construction comprising first electrode and first spacer component, a diaphragm comprising a 2-D material, and a second multilayer construction comprising second electrode and second spacer component, subsequently aligning and attaching the diaphragm to the first multilayer electrode and spacer construction using a first adhesive, and, lastly, aligning and attaching the second electrode and spacer multilayer construction to the diaphragm using a second adhesive.

Optionally, at least the first adhesive or the second adhesive permits an electric current to cross the adhesive and pass to the diaphragm. In a preferred embodiment, the 2-D material comprises graphene. In another preferred embodiment, aligning and attaching the diaphragm to the first multilayer construction is performed using a transfer board.

Further objects, features, and advantages of the present application will become apparent from the detailed description of preferred embodiments which is set forth below when considered together with the figures of drawing.

BRIEF DESCRIPTION OF THE DRAWINGS

Some of the Figures in the application are presented in color. Additionally, some of the Figures in the application include patterned shading; however, such patterned shading does not correspond to materials as shown in MPEP § 608.02(IX) ("Drawing Symbols") (9th Ed. March 2014 R-08.2017).

Several exemplary embodiments of the application are explained below with reference to the drawings, in which.

DETAILED DESCRIPTION OF CERTAIN EMBODIMENTS

The terms "about" or "approximate" and the like are synonymous and are used to indicate that the value modified by the term has an understood range associated with it, where the range can be ±20%, ±15%, ±10%, ±5%, or ±1%. The term "substantially" is used to indicate that a value is close to a targeted value, where close can mean, for example, the value is within 80% of the targeted value, within 85% of the targeted value, within 90% of the targeted value, within 95% of the targeted value, or within 99% of the targeted value.

The term "infrasonic" when referring to an acoustic wave means the acoustic wave has a frequency below the human audible range, i.e. below 20 Hz. The term "ultrasonic" when referring to an acoustic wave means the acoustic wave has a frequency above the human audible range, i.e. above 20 kHz. The term "human audible range" or the like when referring to an acoustic wave means the acoustic wave has a frequency within the human audible range, i.e. between 20 Hz and 20 kHz.

An acoustic wave may be referred to as a sound wave in various parts of this application, or vice versa.

Figure 1:
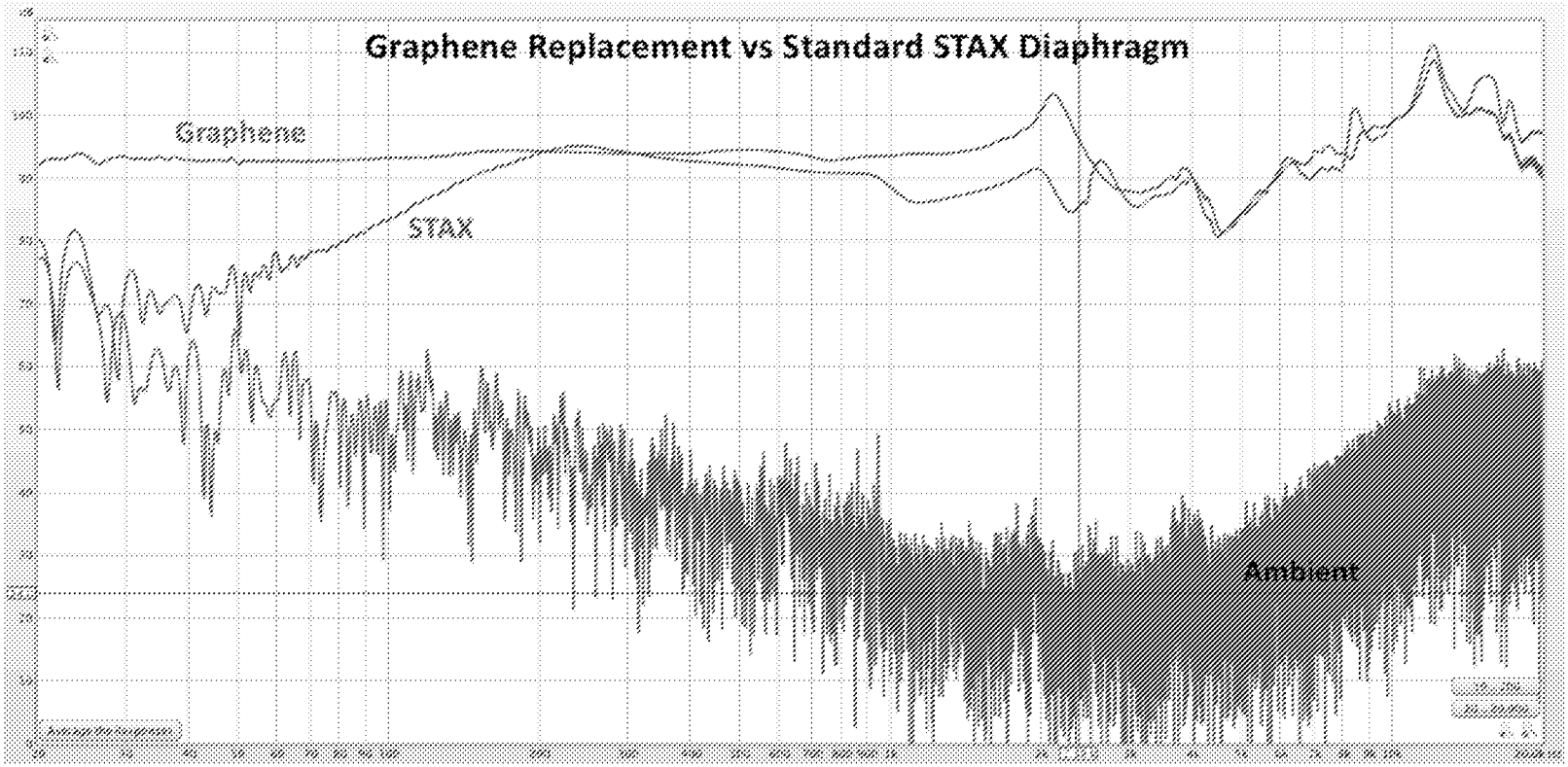
FIG. 1 shows the performance of a commercially available STAX SRS-002 electrostatic ear-speaker using a standard metalized polymer film as the diaphragm compared to the same transducer except that a low-mass graphene diaphragm was inserted into the transducer to replace the standard diaphragm.

FIG. 1 shows the performance of a commercially available STAX SRS-002 electrostatic ear-speaker using a standard metalized polymer film as the diaphragm compared to the same transducer except that a low-mass graphene diaphragm was inserted into the transducer to replace the standard diaphragm. The X-axis shows frequency logarithmically from 20 Hz to 20 kHz, and the Y-axis shows decibels (dB) from 0 dB to approximately 110 dB. The frequency range shown in FIG. 1 corresponds with the human audible range. The transducing devices of the present application may be manufactured by utilizing a novel procedure for producing graphene layers and aligning and mounting those layers in a device. In one embodiment, the graphene material depicted in FIG. 1 may be made according to the procedure as described in Zhou & Zettl et al., *Electrostatic Graphene Loudspeaker*, Appl. Phys. Lett. 102, 223109 (2013). In another embodiment, the device may be made using a novel procedure as described in detail below. Graphene materials may be used according to the subject matter of the various embodiments of this application. FIG. 1 demonstrates that the graphene material outperforms conventional state of the art transducing materials across the human audible range, including, in particular, at the lower end of the range. The graphene material maintains a consistent response across the entire range, whereas the commercially available STAX material produces a weaker response at low frequencies.

In general, in FIGS. 2, 3, 6, and 7, materials colored blue or dark blue are non-conductive dielectric materials such as FR4 (a family of glass-reinforced epoxy laminate materials known as "flame retardant 4"), glass, ceramic, or polymers. FR4 materials having a low thermal expansion coefficient (low CTE) and a high glass transition temperature are preferred among the family of FR4 materials. Such materials include, for example, IS400HR (ISOLA) (150° C. glass transition temperature ($T_g$), 13 ppm/° C. CTE below $T_g$) TERRAGREEN (ISOLA) (200° C. glass transition temperature ($T_g$), 16 ppm/° C. CTE below $T_g$), or other products in this same family with temperature resistant resins systems with high glass transition temperatures used for exposure to harsh operating environments. A person of ordinary skill in the art would be aware of other such suitable dielectric materials. Such layers include (16, 20) as shown in FIGS. 2, 3, 6, and 7. Similarly, the materials colored orange are conductors such as copper or aluminum, or other suitable conductors for electronic devices. Such layers include (17, 21) as shown in FIGS. 2, 3, 6, and 7. In addition, the burgundy layer is a dielectric insulator such as non-conductive epoxy, glass, ceramic or polymer coatings. A person of ordinary skill in the art would be aware of other such suitable dielectric materials. Such layers include (18) as shown in FIGS. 2, 3, 6, and 7. The purple and green layers are glue or epoxy layers for bonding. A person of ordinary skill in the art would be aware of other such suitable bonding materials. Such layers include (19) as shown in FIGS. 2, 3, 6, and 7. In particular, the application is not limited to the materials recited in this paragraph but includes all such materials that would be readily envisioned by one of ordinary skill in the art.

Figure 2:
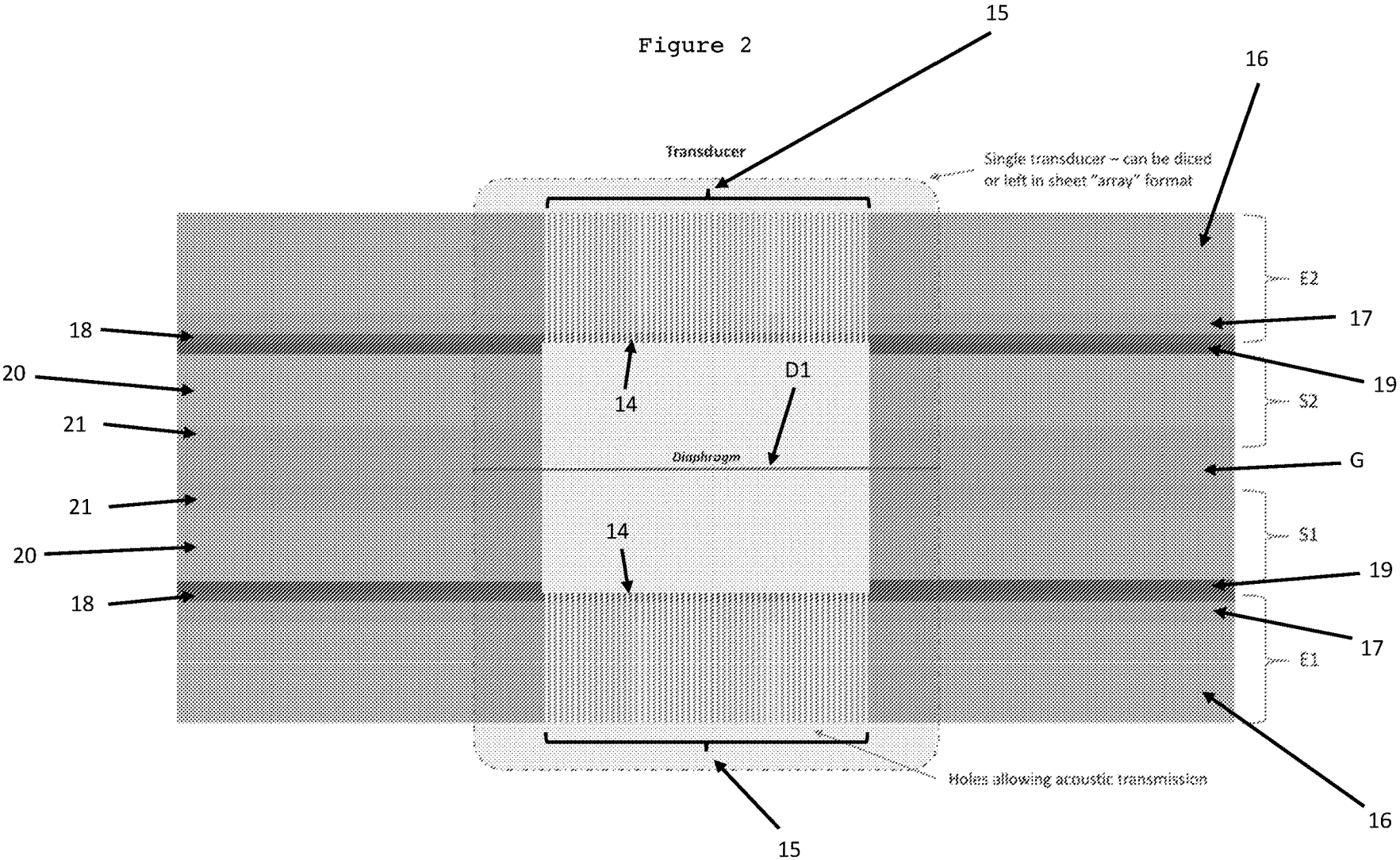
FIG. 2 shows an exemplary embodiment of a device according to the present application.
Figure 3:
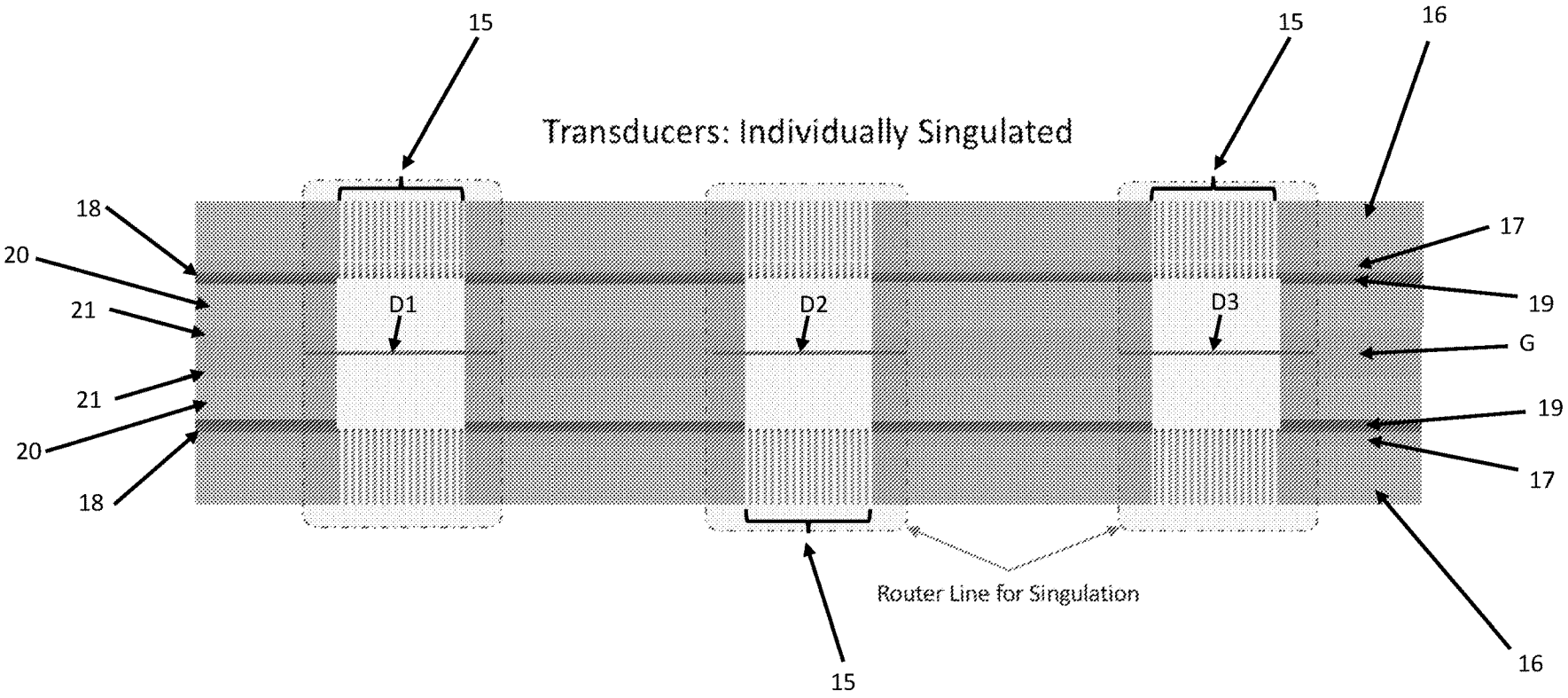
FIG. 3 shows a sheet of transducers to be singulated.
Figure 4:
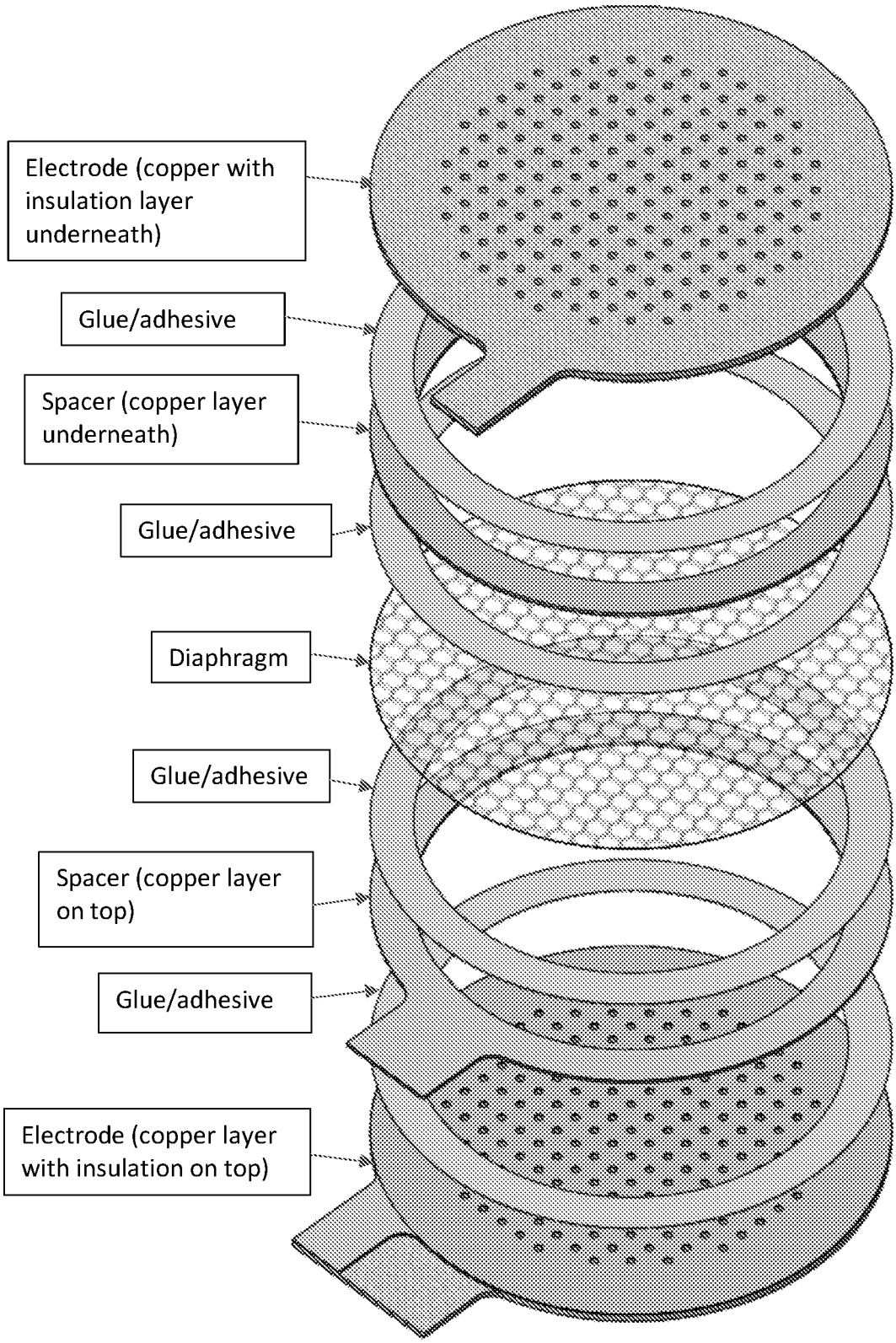
FIG. 4 shows an exploded view of an individual transducer.
Figure 5:
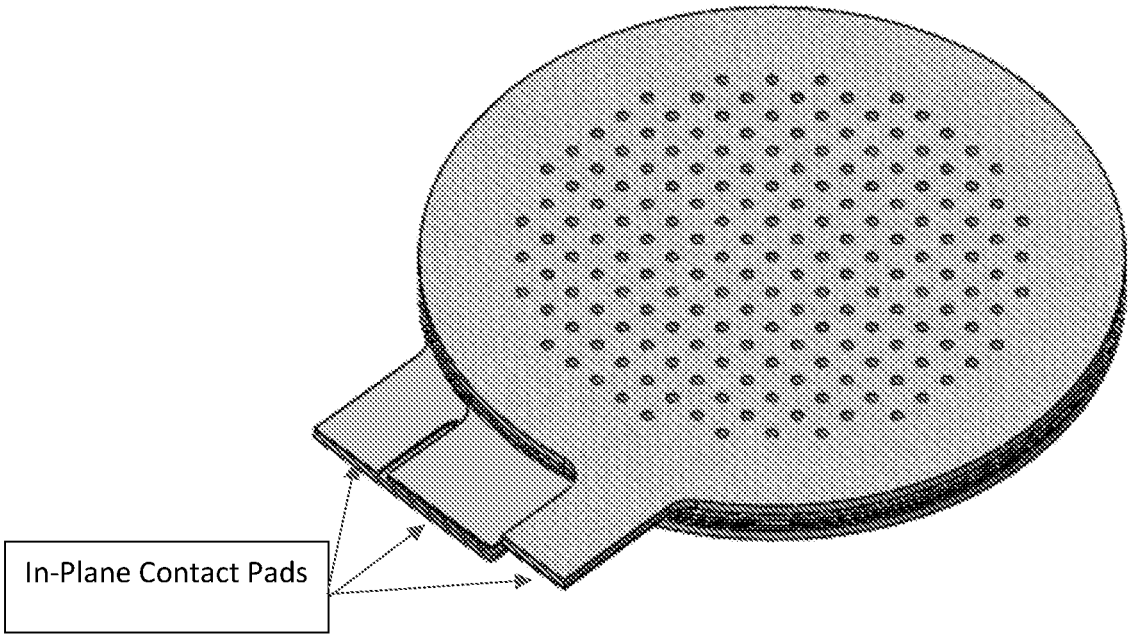
FIG. 5 shows an individual transducer in collapsed view.

FIG. 2 depicts an exemplary embodiment of the electrostatic transducing device according to the present application. FIG. 2 shows two electrode layers (E1, E2), two spacer layers (S1, S2), and one diaphragm (D1). The diaphragm (D1) can be, for example, a 2-D material. In a preferred embodiment, the diaphragm has graphene, but may also comprise other materials which provide support or are included to 'tune' the graphene layer for enhanced audio quality. Much like a traditional electrostatic transducer, the electrode layers (E1, E2) are separated from the diaphragm (D1) by spacer layers (S1, S2) on either side of the diaphragm (D1) in a symmetric device. There are also gaps (G1, G2) between the electrodes (E1, E2) and the diaphragm (D1) determined by the thickness of these spacers (S1, S2). A DC charge is applied to the diaphragm (D1) and an audio signal is applied to the electrodes (E1, E2), typically using a push/pull configuration to produce sound. When the transducer is used as a microphone the configuration is different as typically one electrode is grounded and the other electrode is monitored for electrical current flow caused by capacitance changes arising from acoustic wave displacement of the diaphragm (D1).

The diaphragm (D1) has a transducer active transduction area (1) which can vary. In general, for the thickness and mass of transducers in this application, the area can be approximately the area of a circular suspension with diameters as small as 1 mm for audio applications and 0.1 mm for ultrasonic applications. There is no limit as to how large they may become, the key issue here being the ability to fabricate larger and larger, high-quality diaphragm films of the same thickness for the suspension. The diaphragm suspensions can have a variety of shapes, for example, circle, ellipse, square, rectangle, kidney or other irregular shapes.

In particular, an exemplary embodiment of a diaphragm (D1) is fabricated from pure graphene or a hybrid graphene composite film with other similar high-strength, low-mass films such as Hexagonal Boron Nitride (HBN) or Molybdenum Disulfide ($MoS_2$). Such films may be manufactured according to the subject matter described herein.

In some embodiments, in the diaphragm (D1) it may be desirable to use a composite graphene structure that includes thin layers of HBN, $MoS_2$ or more conventional materials on one or both sides of the graphene layer to provide additional mechanical strength to the diaphragm, to provide a more-flexible, less-rigid mechanical support along the outer perimeter of the diaphragm, or to create a desired displacement pattern across the diaphragm surface to essentially 'tune' or 'enhance' the diaphragm's excursion profile in response to applied electrostatic forces. Such patterns would include, for example in a round diaphragm, patterning a disc at the center or a ring with a certain width and radius into the circular diaphragm. Conventional materials that could be used include but are not limited to polymers such as PEEK (Polyether ether ketone), FEP (Fluorinated ethylene propylene) or a wide range of acrylics, polyesters, silicones, polyimides, polyurethanes, and halogenated plastics. The patterned disc would increase the mass of the diaphragm and reduce its displacement compared to a diaphragm without the patterned disc. Another pattern, the ring for example at the outer edge of the diaphragm would add rigidity to the diaphragm and also reduce its displacement but would enhance its durability. For example, the diaphragm with a patterned ring along its outer perimeter would be able to be driven at higher voltages compared with a diaphragm without a patterned ring.

Figure 8A:
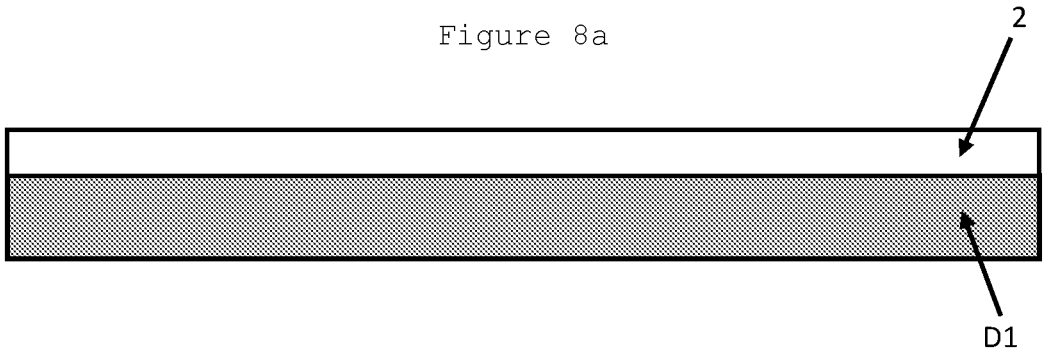
FIG. 8*a* shows additional layers which are part of the diaphragm extending over the entire diaphragm. diaphragm shown in grey.
Figure 8B:
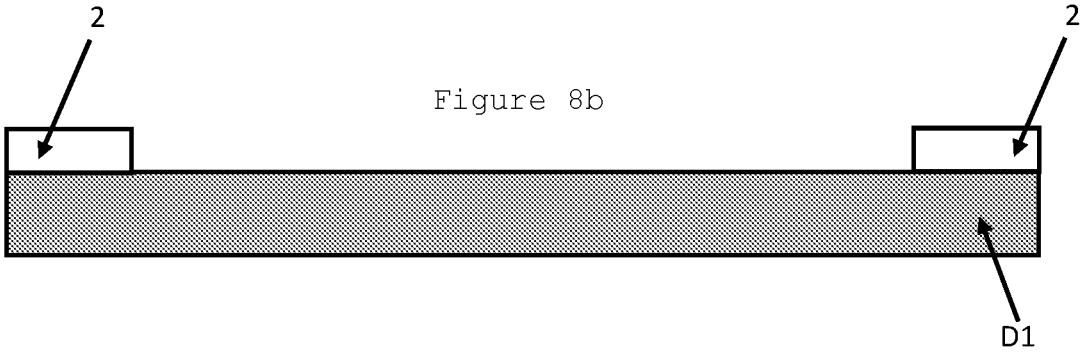
FIG. 8*b* shows additional layers which are part of the diaphragm extending only a short distance from the outer perimeter of the diaphragm.
Figure 8C:
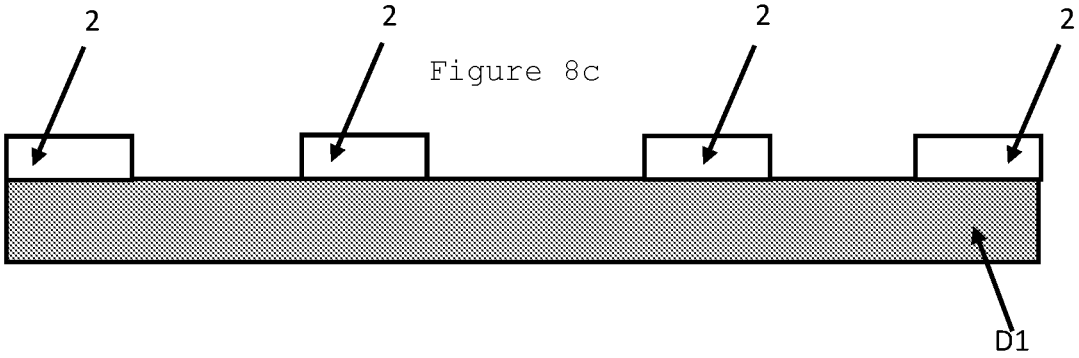
FIG. 8*c* shows additional layers which are part of the diaphragm patterned with a desired design to 'tune' the diaphragm to produce enhanced audio quality.

These additional layers (2) can extend over the entire surface of the graphene diaphragm (D1) as shown in FIG. 8*a* to completely cover the diaphragm, or they can be patterned as mentioned above or so that they extend only a short distance from the outer perimeter (11) of the graphene diaphragm (D1) as shown in FIG. 8*b*, thereby leaving an uncoated, exposed graphene region (12) at the center of the diaphragm (D1), or the layers can be patterned with any desired design as shown in FIG. 8*c*.

As shown in FIG. 9*a-d*, photo-sensitive materials (3) commonly used in the semiconductor manufacturing industry, which include but are not limited to PMMA (Poly [methyl methacrylate]), SU-8 (an organic resin solution that hardens into an epoxy when cured) and many other materials commonly referred to as 'photoresist' (3) could be used to form a blanket or patterned layer where in some regions of the diaphragm the photoresist material is removed from the graphene surface for example by exposure to UV light through a photomask followed by immersion in a developer chemical, although other patterning methods such as shadow-mask, lift-off, polishing, ink-jet printing, 3D-printing, or screen-printing could also be used to pattern the added material. These materials may also be used as blanket or as a backer film to improve yield of graphene diaphragm material during graphene isolation and transfer steps. Such materials may completely removed (i.e., not incorporated into the final device) or may be allowed to remain within the device that is finally fabricated.

Figure 9A:
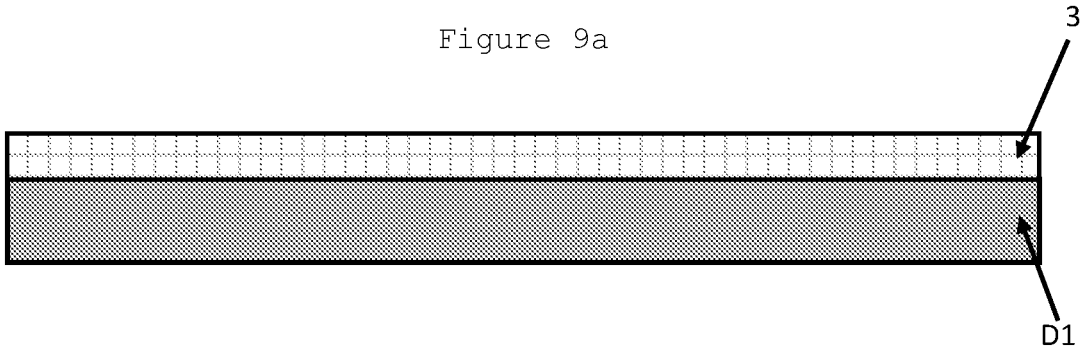
FIGS. 9*a-d* show an exemplary photolithographic technique for applying a patterned additional layer to a diaphragm.
Figure 9B:
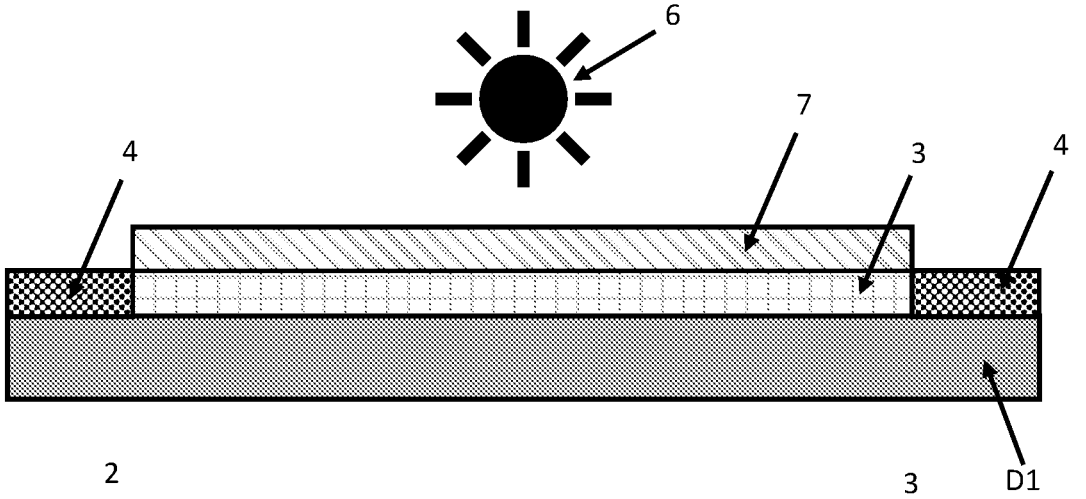
Figure 9C:
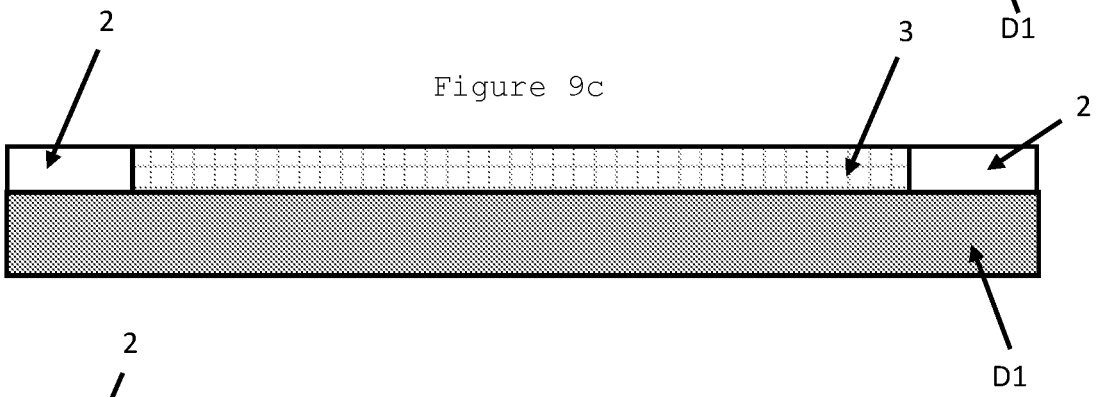
Figure 9D:
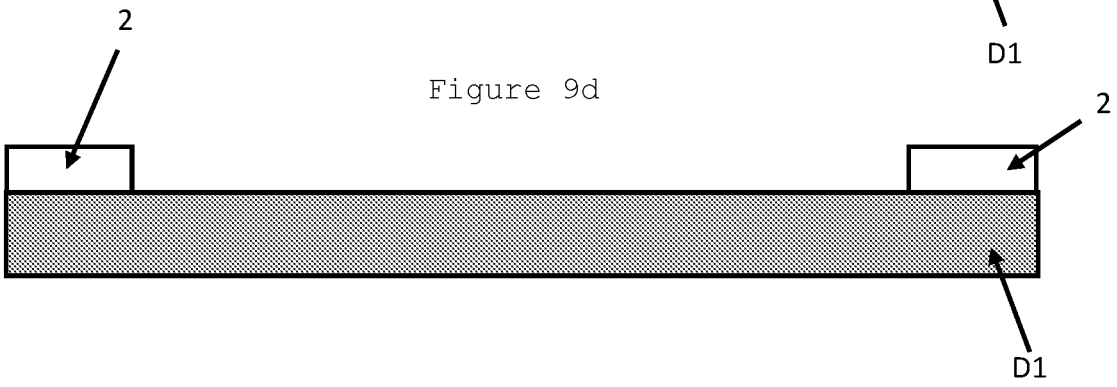

In the example shown in FIGS. 9*a-d*, a photosensitive material (3) is applied to the graphene diaphragm (D1) (FIG. 9*a*). The photosensitive material (3) is then exposed to a curing light source (6) which is masked by a mask (7) such that there are one or more exposed regions (4) which are developed by the light source (6). In the present example, a positive photoresist is used, but one of ordinary skill in the art would understand that a negative photoresist could also be used. The mask (7) is then removed and the exposed areas are removed by a developer. As shown in FIG. 9*c*, the additional layer (2) is then added to the portions of the diaphragm (D1) that are no longer covered by the photosensitive material (3). Lastly, as shown in FIG. 9*d*, the photosensitive material (3) is removed, leaving only the diaphragm (D1) and the additional layer (2).

Figures 10A, 10B, 10C:
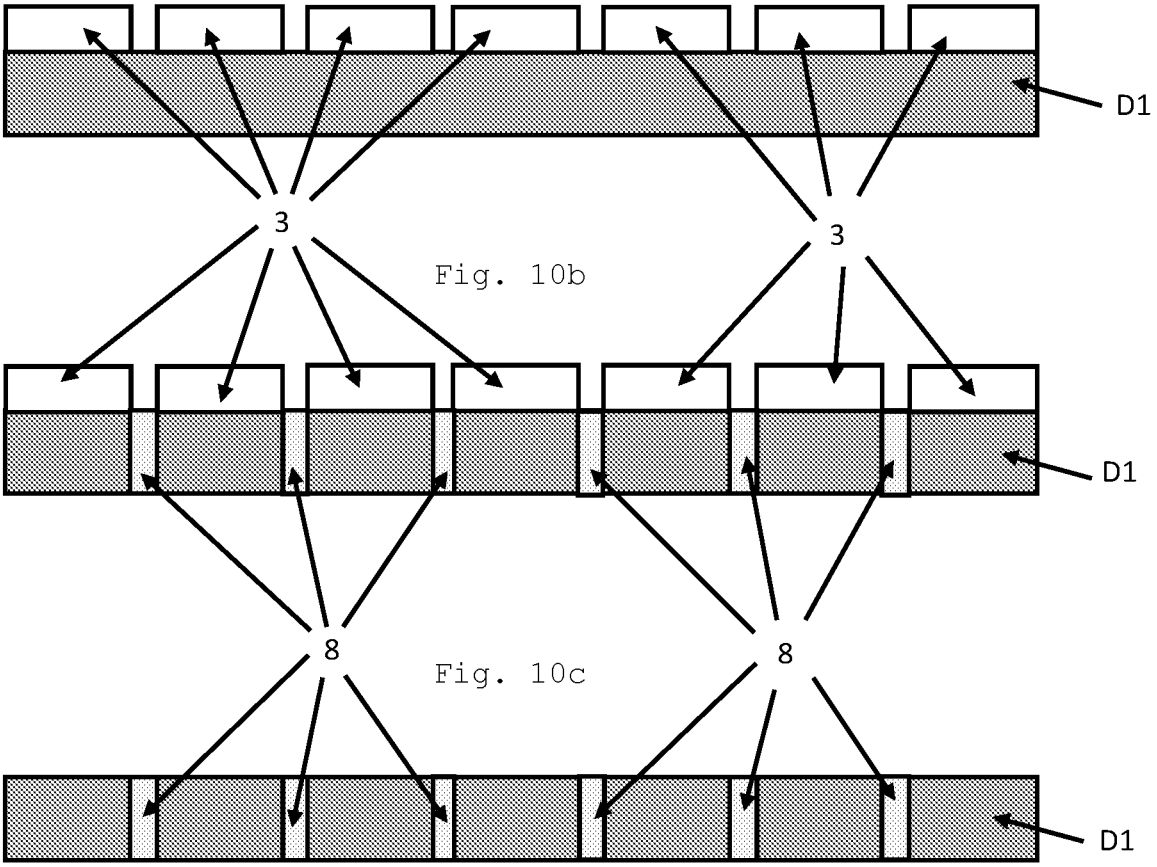
FIGS. 10*a-c* show the patterned material used as a mask to remove graphene in some regions of the diaphragm.

In other embodiments, as shown in FIGS. 10*a-c*, the patterned material (3) can be used itself as a mask to remove graphene in some regions of the diaphragm (D1), thus forming a desired pattern of holes (8) in the graphene of any desired shape according to the photomask design, after which the photosensitive material (3) could either be left in place or could be entirely removed from the diaphragm surface, depending on the desired final diaphragm architecture. In this way, the diaphragm's excursion pattern in response to electrostatic stimuli may be tuned by design of the hole pattern.

The graphene diaphragm of the device can be fabricated per Zhou et al, or another method used in this embodiment where graphene diaphragm layer is fabricated by CVD growth using Methane and $H_2$ gases in a fairly common process setting on a seed layer foil such as Nickel. After deposition, the foil with the graphene on its exterior may then be optionally PMMA spin coated and baked or coated with other such similar film on one side of the foil. It is then placed face down on a "transfer board" with PSA (Pressure Sensitive Adhesive) that has a minimum, or possibly more; slightly oversized transducer active area openings. The transfer board is formatted with alignment holes or markings so that it can align to features on the "bottom" portion of the transducing device, the E1/S1 stack. This alignment can be done by using pins for alignment or other more sophisticated semiconductor or semiconductor packaging alignment methods. Once the PMMA/Graphene/foil is adhered face down to the transfer board, the opposite side of the foil has its graphene removed using oxygen plasma ashing techniques. Then the exposed Nickel foil is wet-etched in ferric chloride or other similar type of etchant that will not attack the underlying graphene layer or composite film; leaving the graphene or optionally a bi-layer film suspended over the transfer board opening. Optionally the transfer board and suspension can then be processed to remove the polymer film; or this film can be left intact either in blanket or patterned form.

The electrodes (E1, E2) and spacers (S1, S2) layers can be fabricated from a variety of materials that are compatible with the variety of manufacturing processes. Materials include metalized coated polymers, rigid or flexible, or fiber reinforced epoxy materials such as FR4, glass or plastics. FR4 materials having low thermal expansion coefficient (low CTE) and a high glass transition temperature are preferred among the family of FR4 materials. Such materials include, for example, IS400HR (ISOLA) (150° C. glass transition temperature ($T_g$), 13 ppm/° C. CTE below $T_g$) TERRAGREEN (ISOLA) (200° C. glass transition temperature ($T_g$), 16 ppm/° C. CTE below $T_g$), or other products in this same family with temperature resistant resins systems with high glass transition temperatures used for exposure to harsh operating environments.

The electrodes (E1, E2) have a dielectric layer for structural integrity (16), a thin conductive layer on the interior to create the electrostatic Voltage plane (17), and optionally a second thin dielectric layer on top of the Voltage plane (18) to prevent electrode arcing on the interior side of the device. The "exterior" side of the electrodes can have pre-fabricated conductive traces for future use in Array configurations or these traces could be formed later with conductive inks using screen-printing, ink-jet or other such methods.

While fabricating the layers containing electrodes (E1, E2), pre-metalized materials with conductors such as copper or aluminum can be used, or the electrodes can be "metalized" using conventional conductive film deposition methods such as sputtering or plating to provide the conductive layers. To simplify the process for devices that are intended to be individually singulated, no exterior electrode conductor is needed, instead in-plane layered device contacts may be produced in tab form by pre-routing the necessary pattern as the electrode and spacer are assembled.

For devices intended to be used in an array format, for example as shown in FIGS. 3, 6, 7, and 13-17, conductor layers can be patterned using methods developed for multilevel PCB, MEMS devices, display or even semiconductor devices in order to interconnect the respective devices on the "outer" side of these layers.

In another embodiment, the array configuration could be assembled and interconnected using a separate interposer style board providing the desired electrical routing, with wire bonding for electrical connectivity to the singulated or grouped transducers and mechanical gluing to adhere these devices.

The "inner" side (14) of the electrode layers requires a metal conductive layer for the $V_{AC}$ signal and is typically copper or aluminum but could be any other conductive film. This layer can be patterned using standard etching and patterning methods or left continuous across the sheet in some cases. This conductive layer also can have a passivation layer on it sufficient to stop potential short-circuit events from occurring if the diaphragm were to come into contact with the electrode layers. This passivation can be a non-conductive epoxy material or other dielectric material that can be patterned using screen printing, photolithography, shadow masking or other such techniques.

The electrodes have acoustic transmittal holes (15) located over the spacer opening, which comprises the active transducer area and allows acoustic transmission. These acoustic holes can vary in size, being as small as one micron and produced with semiconductor etching methods, and as large or larger than 1 mm using a variety of drilling methods. The pattern of the holes can vary based on acoustic considerations, changing in size, aspect ratio, pitch and periodicity; but generally, an open area of 25-40% is desired to reasonably balance electrostatic force with acoustic transmission.

The spacers (S1, S2) are generally comprised of two layers: 1) dielectric layer(s) (20) to create the spacing in between the electrode and the diaphragm; and 2) a conductive layer (21) to which the diaphragm can be bonded. The conductive layer (21) also can provide routing for an external contact. The removal of the dielectric and conductive film creates the active transducer area. The combined thicknesses of the dielectric and conductive films will produce the "gap" or space between the electrode's Voltage plane and the diaphragm. As discussed before, the opening in the spacer layer can be a variety of shapes, but it is important that the conductive film portion of this layer is continuous around the entire perimeter of this shape. This perimeter conductive film is where the diaphragm will be bonded, in a uniform quality bond giving consistent mechanical and electrical properties around the entire active perimeter of the transducer.

Both the electrode and spacer layers can have these openings/holes patterned in a variety of ways, depending on the geometries and overall manufacturing methods being employed. For standard PCB manufacturing, techniques like mechanical drilling/routing or laser drilling/ablation techniques would work; and for MEMS, display or semiconductor manufacturing, photolithographic patterning and etching methods would also be possible. The spacer openings can vary in shape and size depending on the transducer design and the electrode hole patterning can vary in size and placement depending on desired acoustic performance.

Sheet to sheet, or round to round methods are then used to align and bond the electrode layers to the spacer layers. In a typical sheet to sheet printed circuit Board (PCB) the panels can be aligned and bonded in numerous ways to produce E1/S1 or "bottom" and E2/S2 "top" portions of the device.

To complete the device, the transfer board with the diaphragm suspension is then aligned over the "bottom" device, which has glue evenly applied to the entire perimeter of the spacer conductive perimeter for the device. It is important to have a very uniform and complete periphery bonding so such methods like stamping or other controlled bonding dispensing methods are important. The transfer board is then lowered into position on the "bottom" and the periphery bonding is completed by curing the glue in place. After the diaphragm (D1) layer is attached by glue (G) to the "bottom" of the device, the transfer board is removed by shearing the diaphragm at the perimeter of the transfer board and lifting away the transfer board. The "top" half with glue is aligned and attached to the "bottom" that now has the diaphragm attached, thus encapsulating the transducer diaphragm and completing its structure. At least one of these gluing steps (green layer (G) which is done in two parts) should be done with conductive materials or should be sufficiently thin to allow the tunneling (or leaking) of current to charge the diaphragm.

Generally the last step is a cure bake to properly set the glues.

Individual transducers may be manufactured in an array such that shown in FIGS. 3, 6, 7, and 13-17. The format for manufacturing an array of individual devices at the same time can be a sheet format such as used by printed circuit board manufacturers but also can be a roll-to-roll format. Round formats are also possible such as the wafers used in conventional semiconductor or MEMS manufacturing, particularly as diaphragm sizes shrink and overlay (layer-to-layer alignment) requirements become more stringent. However, when the device size is relatively large, the manufacturing processes and materials are compatible with sheet-to-sheet or roll-to-roll processes, which are proven cost-effective methods for high-volume manufacturing. The lateral spacing between individual devices can vary; however, it is important to maintain consistent vertical spacing between each layer. Therefore, uniform layer thicknesses and use of highly-planar bonding methods are important in some embodiments, particularly in the open area, or cavity, between the diaphragm and each electrode where diaphragm-to-electrode parallelism and equal "gapping" from the diaphragm to each electrode can be important.

During fabrication of the top and bottom of the device, the layers are bonded using glues/epoxies (purple layers, FIG. 2) or in the case of PCB methods "pre-peg" materials (pre-impregnated with composite fibers typically including a thermoset epoxy) can be used. The electrode and spacer layers both provide structural integrity and planarity to the device; however, it is conceivable that when manufactured in an array in a flexible format such as roll-to-roll, rigid inserts or no-flex polymer modified zones could be used to maintain device planarity in the active transduction area.

A first important manufacturing feature in another preferred embodiment includes a continuous charge conduction path created along the entire perimeter of the diaphragm suspension and the method of contacting the various layers of the transducer. The diaphragm in electrostatic audio transducers is typically charged using a constant direct-current (DC) voltage ($V_{DC}$). Typically, it might be assumed that a simple contact point to the diaphragm would enable the charge to disperse through normal conduction over its entire surface. This does, in fact, happen, however in a device with such low current flow and where the mechanical bonding works hand-in-hand with the electrical requirements, it is preferable to have a continuous electrical and mechanical bond around the entire perimeter of the active transduction area.

The electrical path to the graphene diaphragm (D1) does not necessarily have to be low resistance. In fact, it may be preferable that the epoxy/glue line (G) used to adhere the graphene (typically) to a metal conductor (21) along the graphene's perimeter can also function as a series resistor to help maintain a near-constant charge concentration on the diaphragm. In some instances, thin glue lines (G) of non-conductive epoxies on top of a copper trace around the perimeter may be the preferred bonding method to the diaphragm, and, in addition to being an adhesive, can also act as a series resistor that helps provide constant charge on the diaphragm, which improves transducer audio performance by reducing distortions and other undesirable effects that can arise when diaphragm charge is allowed to change rapidly. In this way the glue line can replace at least one resistor in the system, thereby leading to lower transducer size, weight, and cost. In order to be effective as a charge-control resistor, the product of glue-line resistance $R_{GL}$ and diaphragm-to-electrode capacitance $C_{DE}$ must be high enough to limit the diaphragm's voltage time response to less than $1/f_{audio}$, where $f_{audio}$ is the minimum audio frequency of the transducer so that $R_{GL}C_{DE}<1/f_{audio}$.

A second important manufacturing feature in another preferred embodiment includes the method for contacting the conducting surfaces of the device to transmit $V_{DC}$ to the diaphragm (D1) and the alternating-current (AC) audio voltage signal ($V_{AC}$ Signal) to the electrodes (E1, E2). In conventional manufacturing approaches, traditional contact methods utilize VIAs (vertical interconnect architectures) with metalized holes running vertically through PCB layers. This works quite successfully for normal electronic devices and circuit board designs; however, electrostatic transducers use higher voltages than typically encountered and some layers (such as the diaphragm) require very high impedance to function correctly. A different contact method is described herein where each electrical plane of the device (E1, E2, and D1) is contacted directly through an edge connector method that requires integration of open areas into the device architecture to form Tabs which have "pads" that can be accessed electrically after device singulation.

Figure 12:
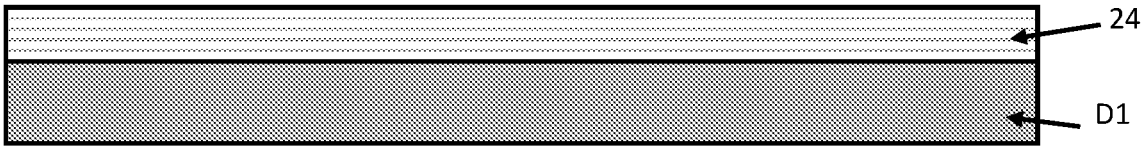
FIG. 12 shows a sacrificial film or structure that can be removed with solvent and vacuum forming instruments for diaphragm handling processes.

A third important manufacturing feature in another preferred embodiment is handling the thin graphene diaphragm prior to being assembled between the two electrodes. While graphene is strong enough to produce loud audio signals, the diaphragm may be susceptible to puncture or tearing prior to singulation. Process steps to align, mechanically support and physically stretch the diaphragm are used to ensure repeatable device performance. Sacrificial films and structures (24), for example, as shown in FIG. 12, such as polymer films that can be removed with solvent and vacuum forming instruments, are key to the diaphragm handling processes but may or may not remain in the final device after singulation.

Impedance and contact issues need to be carefully considered in multi-device array configurations and new design rules may need to be considered to accommodate electrical routing in these configurations. For singulated and mono-channel array devices the edge connector plane connector is a simple solution and avoids via and small-area contact issues. A simple edge style micro-connector can be developed to translate the connections for the device pads into the functionality of the end product. As an Array external electrical routing will occur on both external electrodes. These device connections can be obtained from the Tab Pad to signal routing by wire bonding methods. More complicated through hole via device contact schemes can be developed if needed based on high voltage design rules.

Figure 6:
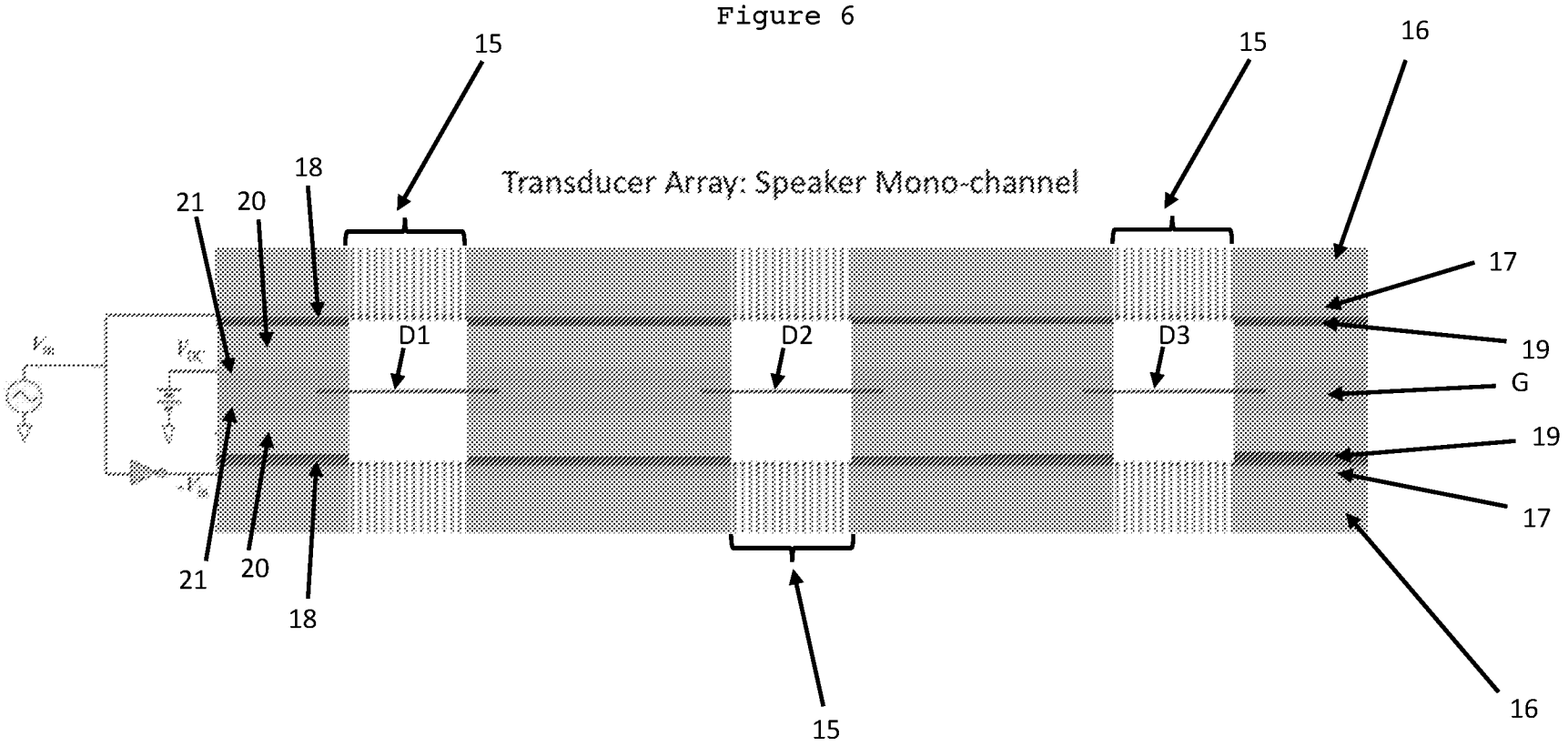
FIG. 6 shows a transducer array configured as speakers in a mono channel configuration.
Figure 7:
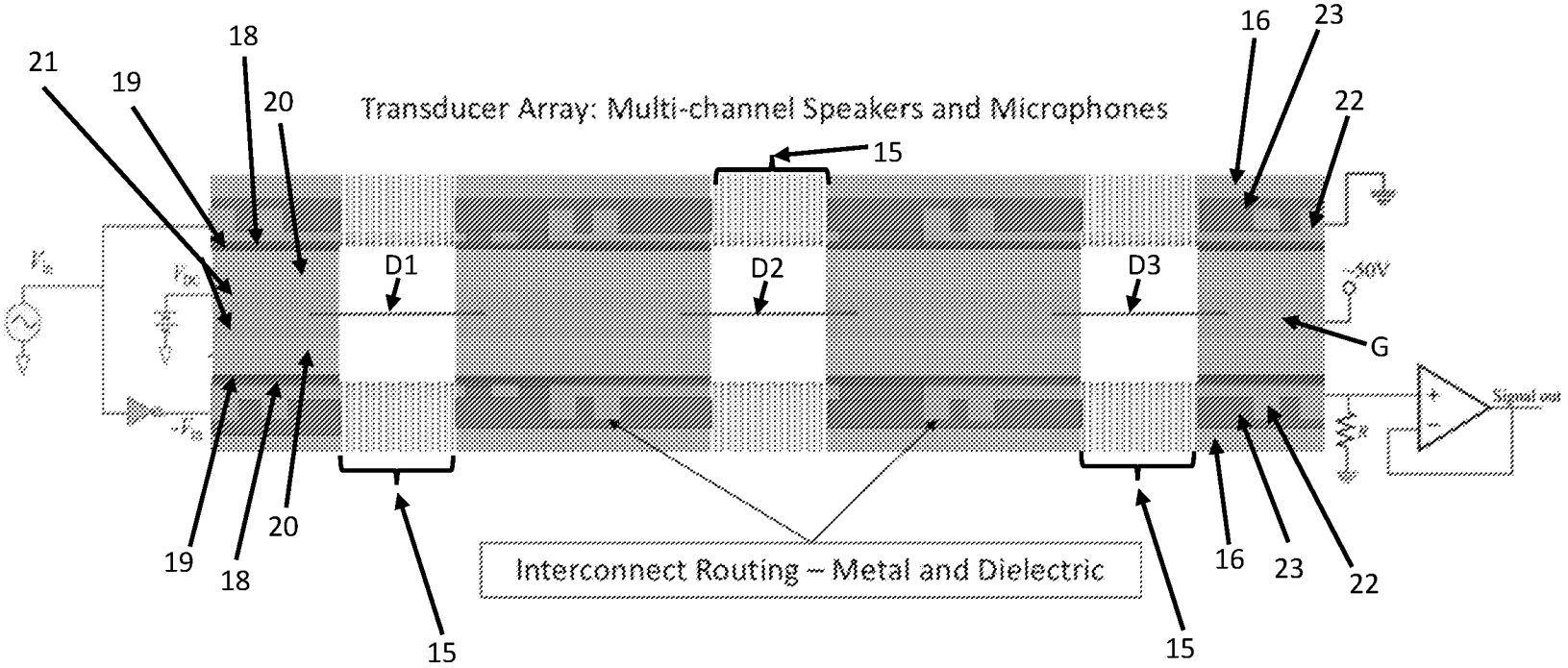
FIG. 7 shows a transducer array configured as speakers and microphones in a multichannel configuration.

As an array, the device could be fully dedicated to producing acoustic waves (subsonic, audible sound and ultrasonic), fully dedicated as an ultra-wideband microphone or could be partitioned with transducers performing each of those tasks simultaneously. Such arrays have multiple diaphragms (D1, D2, D3). In one embodiment, as shown in FIG. 6, all the transducers could be fixed as either a speaker or a microphone; and in another, each transducer could be switched from microphone to speaker so that the overall device configuration could be altered for the intended application, as shown in FIG. 7. Such a configuration includes at least one interconnect routing layer (9) which includes conductive materials (22), as well as dielectric materials (23) to allow each transducer to be individually addressed (i.e., the circuitry in the array has the ability to address and control individual transducers in a multiplexed array such that the array would have the ability to simultaneously have some transducers operating as audio speakers and others as microphones).

As a microphone, the device array could detect sound either through one channel or multi-channels in a similar method as described above. When used as a microphone one transducer electrode is connected to a ground terminal and the second electrode is connected in mono or in multichannel mode to a sensing circuit that detects changes in Voltage (or Capacitance) as acoustic waves induce vibrations in the diaphragm that change the diaphragm-to-electrode spacing, thus causing a change in capacitance and also voltage.

Figure 11:
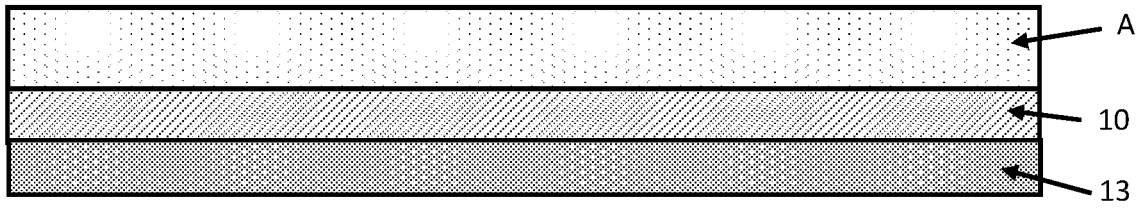
FIG. 11 shows an array of transducers affixed to a surface with a stand-off layer.

As shown in FIG. 11, when the array device (A) is affixed to a surface (13) or other substrate, it may also be desirable to use a stand-off layer (10) between the attachment point and the transducer array (A). This stand-off layer (10) is meant to tune the back-volume acoustics of the transducer and can be designed in path(s) and cross-sectional area to produce beneficial acoustics for the array device.

Figure 13:
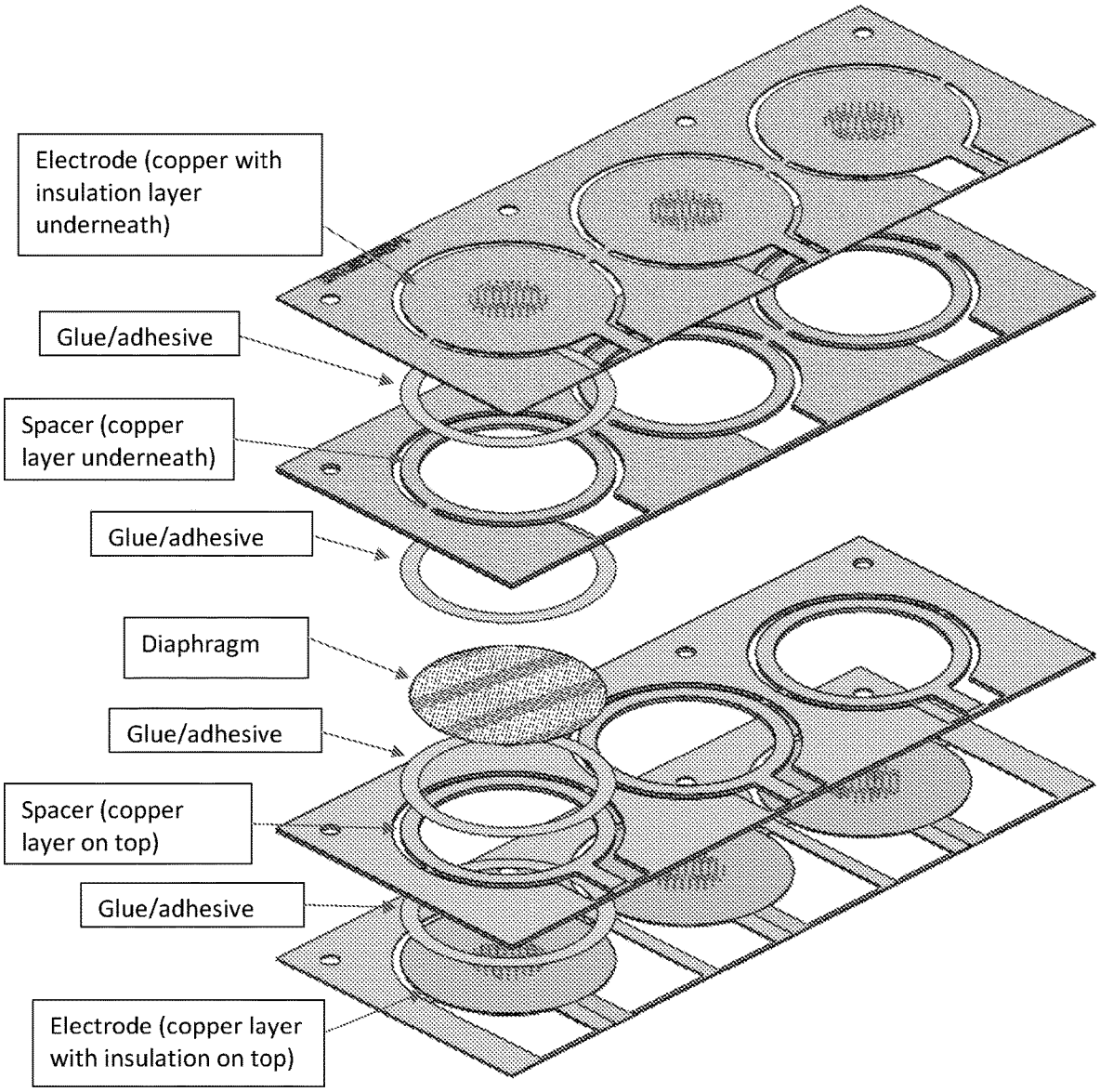
FIG. 13 shows an exploded diagram depicting 1×3 array of transducers manufactured in layers.
Figure 14:
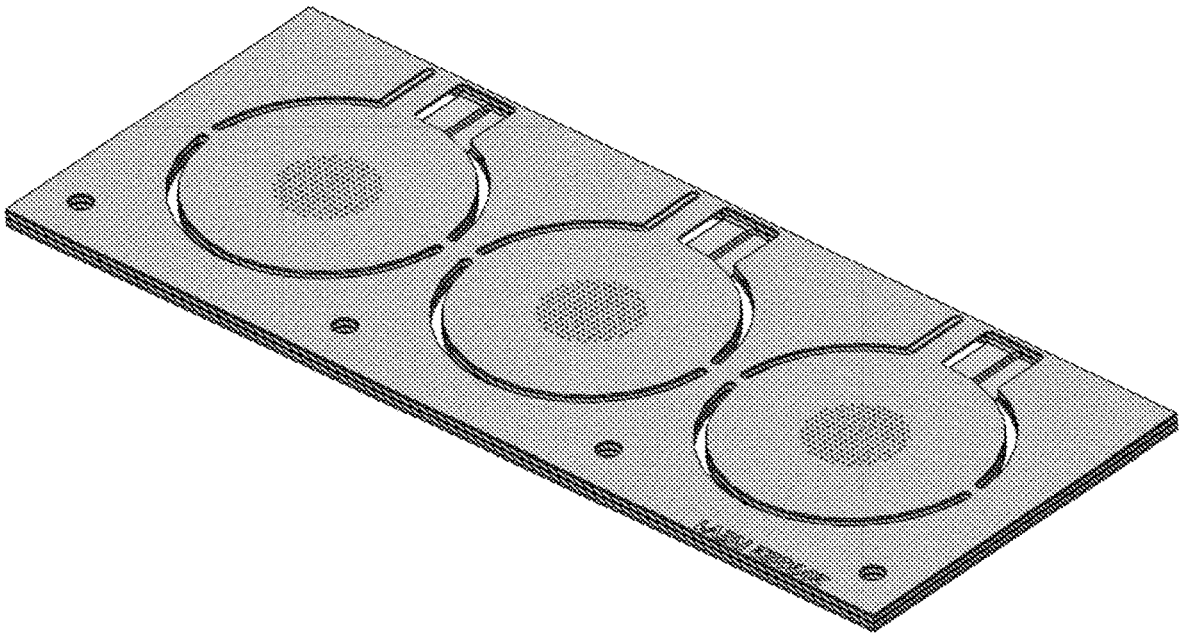
FIG. 14 shows a perspective diagram depicting a collapsed 1×3 array of transducers as shown in FIG. 13.
Figure 15:
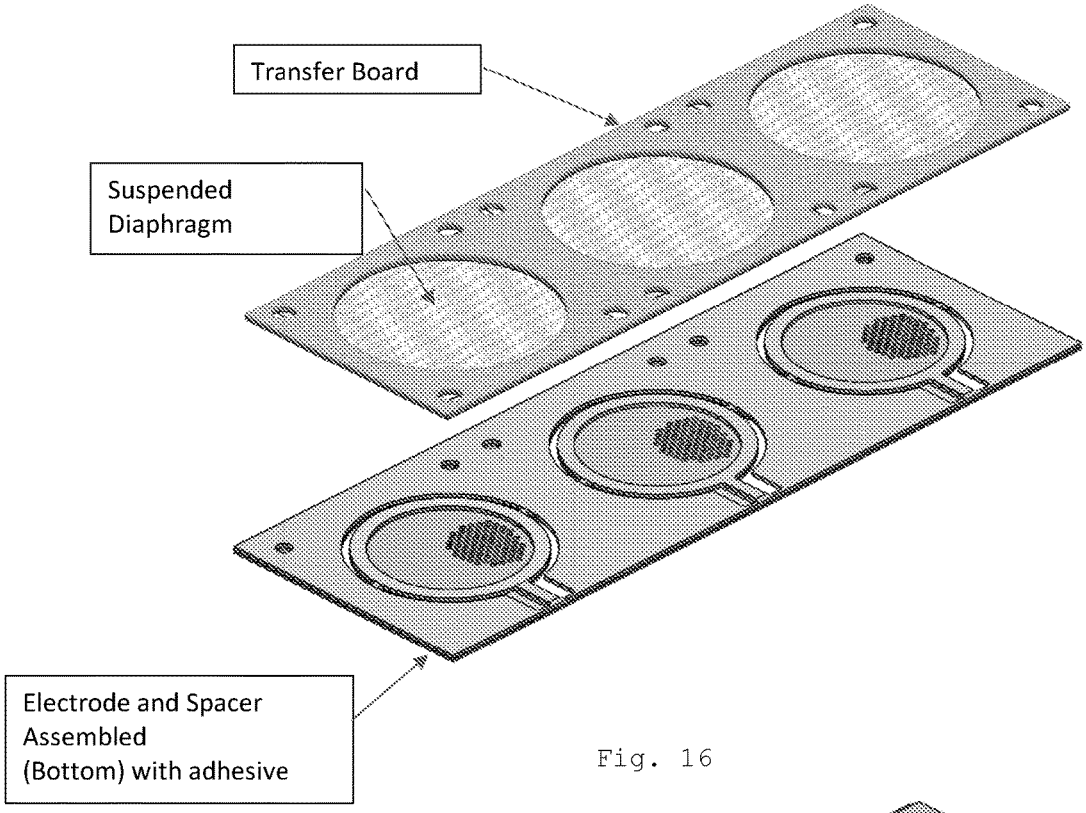
FIG. 15 shows a bottom assembly with a transfer board aligned above it and ready to be lowered for batch diaphragm bonding.
Figure 16:
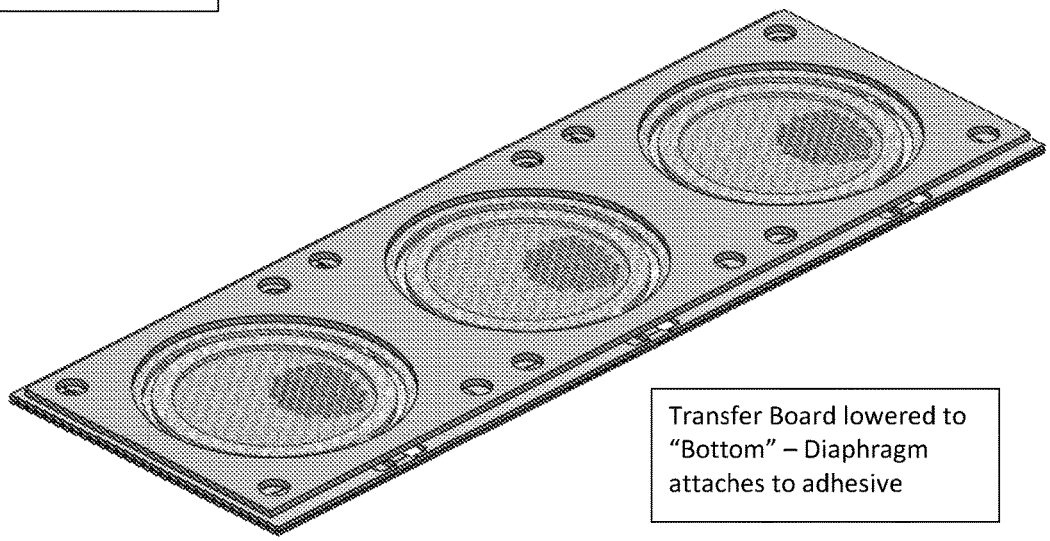
FIG. 16 shows the transfer board lowered into place for the batch diaphragm bonding process.
Figure 17:
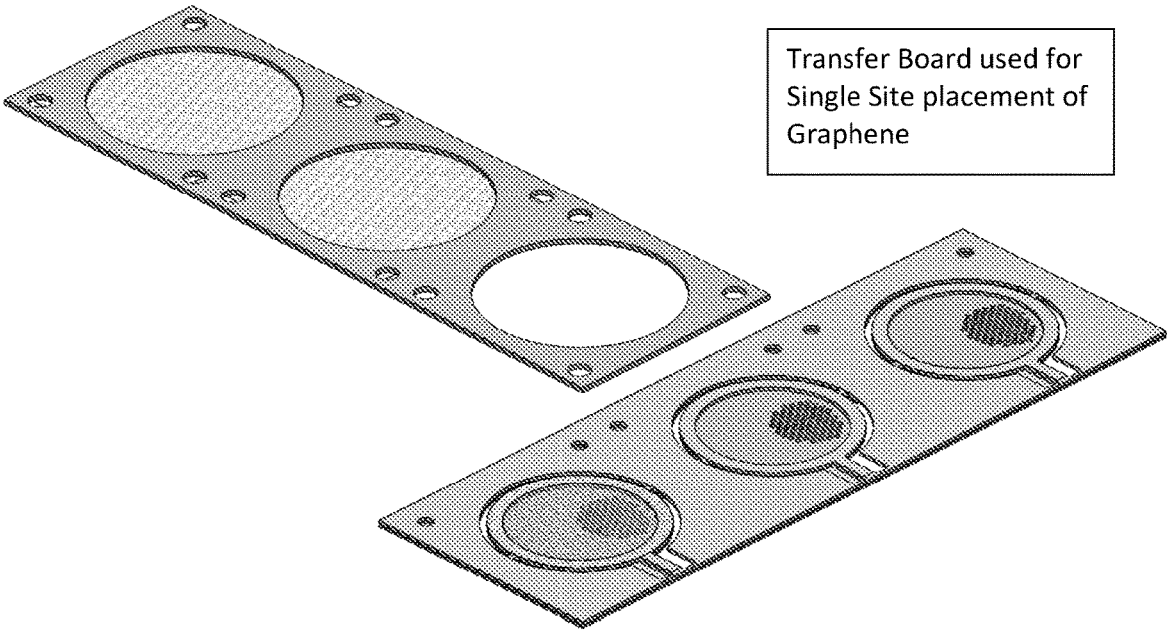
FIG. 17 shows the bottom assembly with the transfer board orthogonally aligned over it and ready to be lowered for a single diaphragm bonding.
Figure 18:
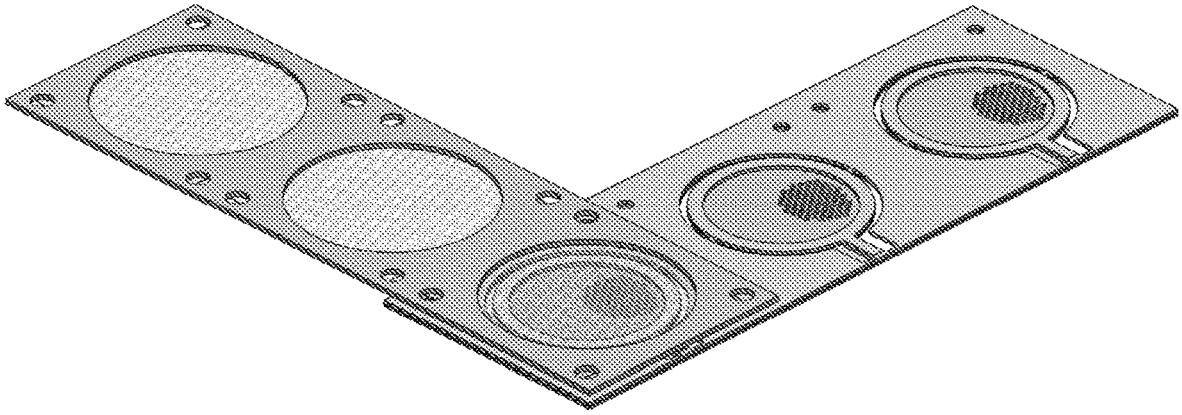
FIG. 18 shows the transfer board lowered into place for the single diaphragm bonding process.

As shown in FIGS. 13-17, the transducing devices according to the present claims may be manufactured in arrays, for example in 1×3 arrays. These arrays may be individually singulated or multiplexed. FIG. 13 depicts an exploded diagram depicting 1×3 array of transducers manufactured in layers. FIG. 14 depicts a collapsed array of devices according to FIG. 13. Just as easily a larger sheet of devices could be fabricated such as a 3×3 array or even larger for a sheet batch processing method, or a longer single device strips and single device fabrication methods can be used. FIG. 15 shows a fabricated "bottom" device with transfer board with a suspended diaphragm in place. In the case all three devices may have the suspended diaphragm bonded in a batch process. In FIG. 16 shows the transfer board lowered in place over the bottom assembly. FIG. 17 and show the raised and lowered positions, but rather than matching up for a batch bond, the devices are individually indexed from orthogonal strips of bottom assembly and transfer boards and positioned to bond each diaphragm one at a time. After this process each strip or sheet then has the top assembly bonded/then cured to it to complete the device assembly. The devices can then be tested at this point and singulated by cutting the small tabs.

Figure 19:
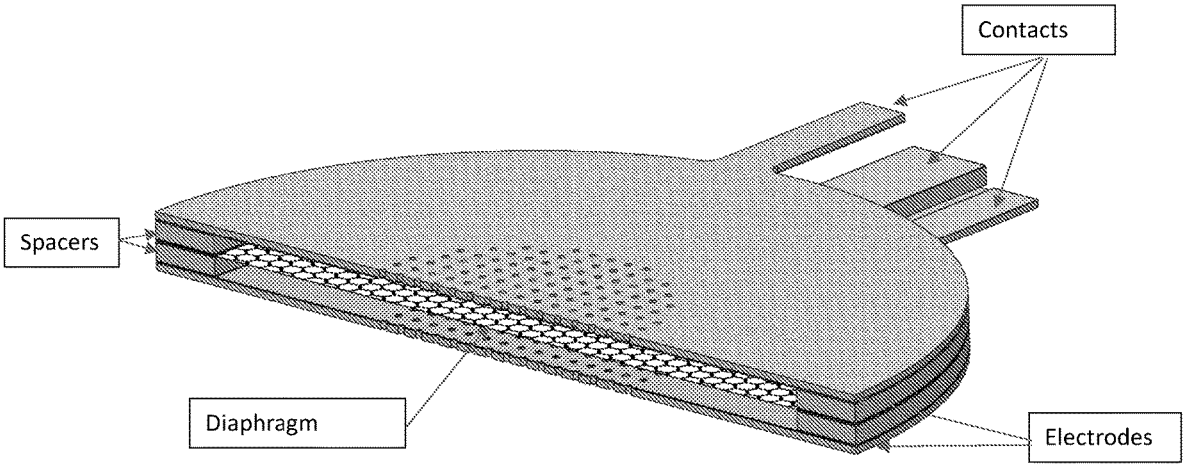
FIG. 19 shows a cross-sectional view of one transducer in an array of 1×3 transducers as shown in FIGS. 13-14.
Figure 20:
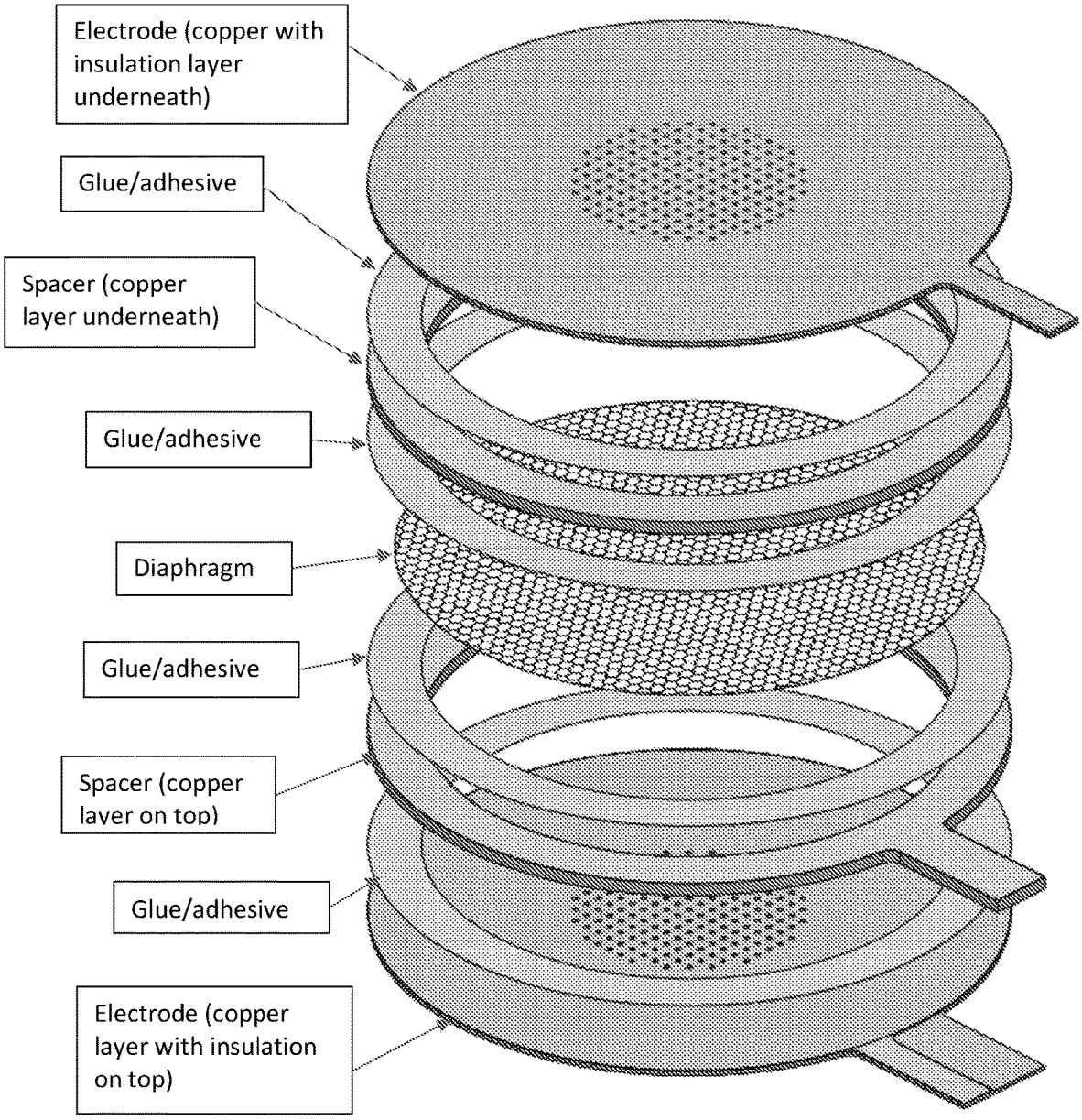
FIG. 20 shows a perspective diagram depicting an exploded transducer according to FIG. 14.
Figure 21:
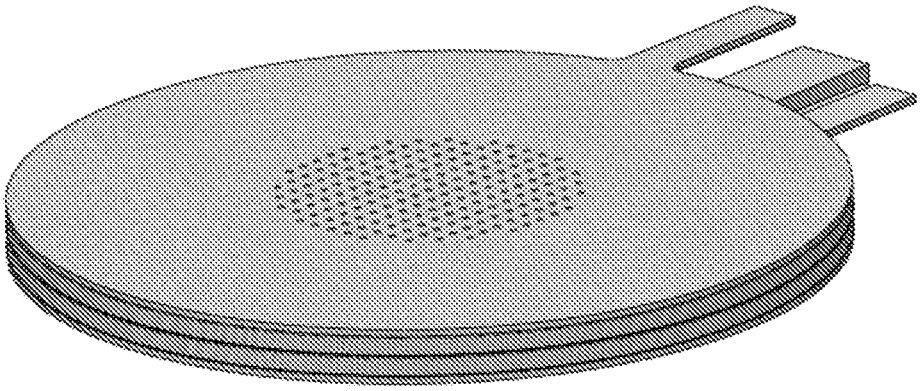
FIG. 21 shows a perspective diagram depicting a collapsed transducer according to FIG. 16.

FIG. 19 shows a cross-sectional view of one transducer in an array of 1×3 transducers as shown in FIGS. 13-14. FIG. 20 shows a perspective diagram depicting an exploded transducer according to FIG. 14. FIG. 21 shows a perspective diagraph depicting a collapsed transducer according to FIG. 20. In preferred embodiments of the devices shown in FIGS. 13-21, the diaphragm in the device has a diameter of approximately 10 mm. In another preferred embodiment, the diaphragm has a diameter of approximately 20 mm. In another preferred embodiment, the diaphragm has a diameter of 1 μm to 10 μm. In another preferred embodiment, the diaphragm has a diameter of 10 μm to 100 μm. In another preferred embodiment, the diaphragm has a diameter of 100 μm to 1 mm. In another preferred embodiment, the diaphragm has a diameter of 40 μm to 1 mm. In another preferred embodiment, the diaphragm has a diameter of 1 mm to 10 mm. In another preferred embodiment, the diaphragm has a diameter of 1 mm to 35 mm. In another preferred embodiment, the diaphragm has a diameter of 1 mm to 100 mm. In another preferred embodiment, the diaphragm has a diameter of 10 mm to 20 mm. In another preferred embodiment, the diaphragm has a diameter of 10 mm to 100 mm. In another preferred embodiment, the diaphragm has a diameter of 100 mm to 1000 mm. In another preferred embodiment, the diaphragm has a diameter of 1000 mm to 10 cm. In another preferred embodiment, the diaphragm has a diameter of approximately 1 mm. In another preferred embodiment, the diaphragm has a diameter of approximately 10 mm. In another preferred embodiment, the diaphragm has a diameter of approximately 20 mm. In another preferred embodiment, the diaphragm has a diameter of approximately 30 mm. In another preferred embodiment, the diaphragm has a diameter of approximately 40 mm. In another preferred embodiment, the diaphragm has a diameter of approximately 50 mm. In another preferred embodiment, the diaphragm has a diameter of approximately 60 mm. In another preferred embodiment, the diaphragm has a diameter of approximately 70 mm. In another preferred embodiment, the diaphragm has a diameter of approximately 80 mm. In another preferred embodiment, the diaphragm has a diameter of approximately 90 mm. In another preferred embodiment, the diaphragm has a diameter of approximately 100 mm.

In preferred embodiments of the present subject matter, the gap between the electrode and the diaphragm is 500 μm to 5 mm. In another preferred embodiment, the gap is 500 μm to 1 mm. In another preferred embodiment, the gap is 100 μm to 1 mm. In another preferred embodiment, the gap is 1 mm to 2 mm. In another preferred embodiment, the gap is 2 mm to 3 mm. In another preferred embodiment, the gap is 3 mm to 4 mm. In another preferred embodiment, the gap is 4 mm to 5 mm.

In preferred embodiments of the present subject matter, a voltage applied to the diaphragm and/or the electrode is 1 volt (V) to approximately 6 kV. In another preferred embodiment, the voltage is 1 V to 10 V. In another preferred embodiment, the voltage is 10 V to 100 V. In another preferred embodiment, the voltage is 100 V to 1 kV. In another preferred embodiment, the voltage is 1-4 kV. In another preferred embodiment, the voltage is 1-6 kV. In another preferred embodiment, the voltage is 4-6 kV.

Figure 22:
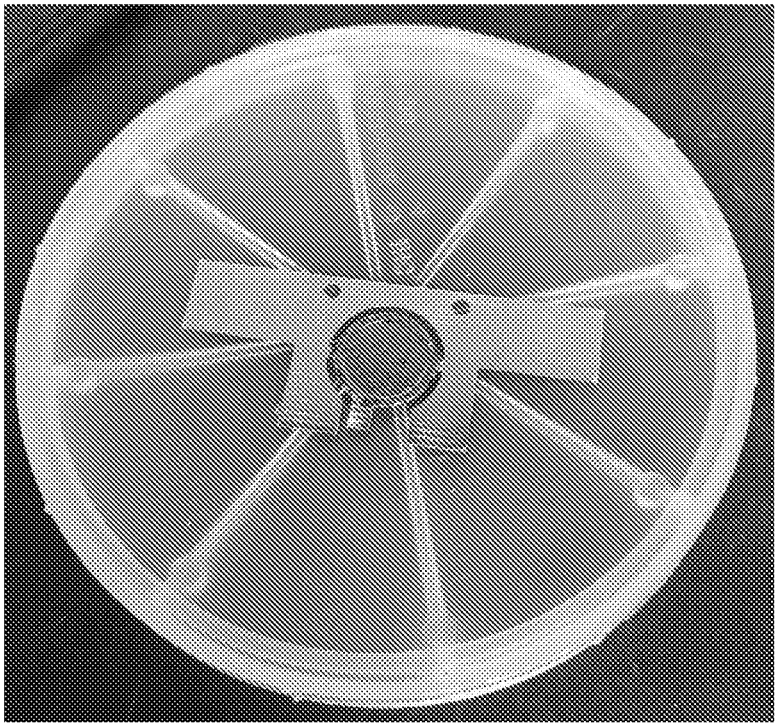
FIG. 22 shows a single 10 mm test device "bottom" assembly with a Graphene diaphragm bonded to it.
Figure 23:
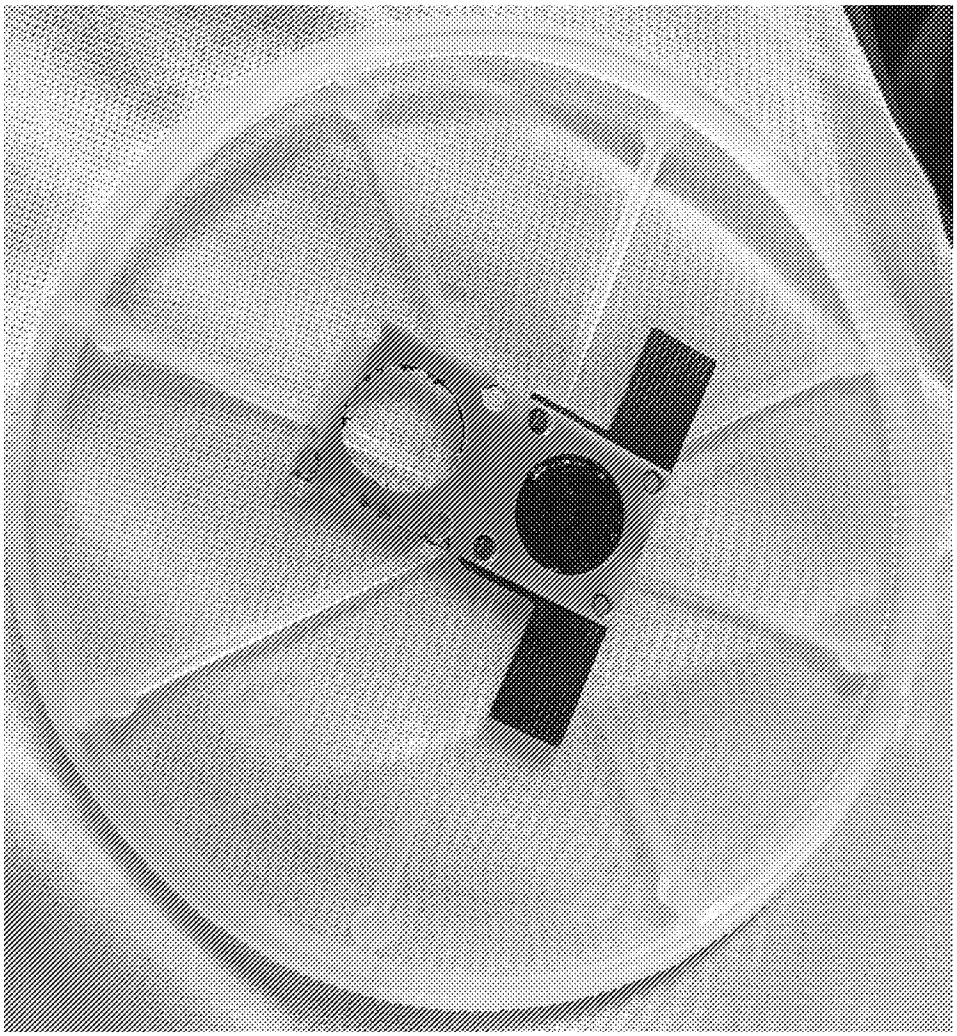
FIG. 23 shows a single 10 mm test device "bottom" assembly with a lowered 2 position transfer board during the diaphragm bonding process.
Figure 24:
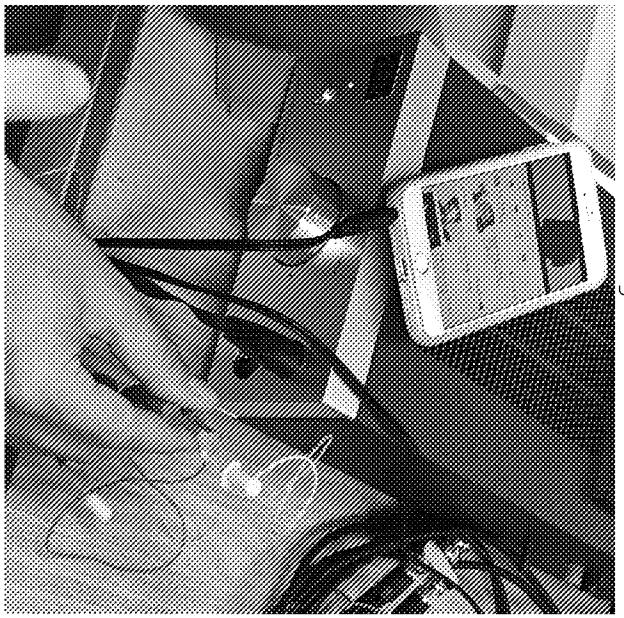
FIG. 24 shows a single fully assembled 10 mm test device during audio testing.

FIG. 22 shows a 10 mm "bottom" test device with a graphene diaphragm glued to the assembly. FIG. 23 shows the lowered transfer board as the graphene is in the process of being bonded. FIG. 24 shows a test device which is wired up to produce sound.

Figure 25:
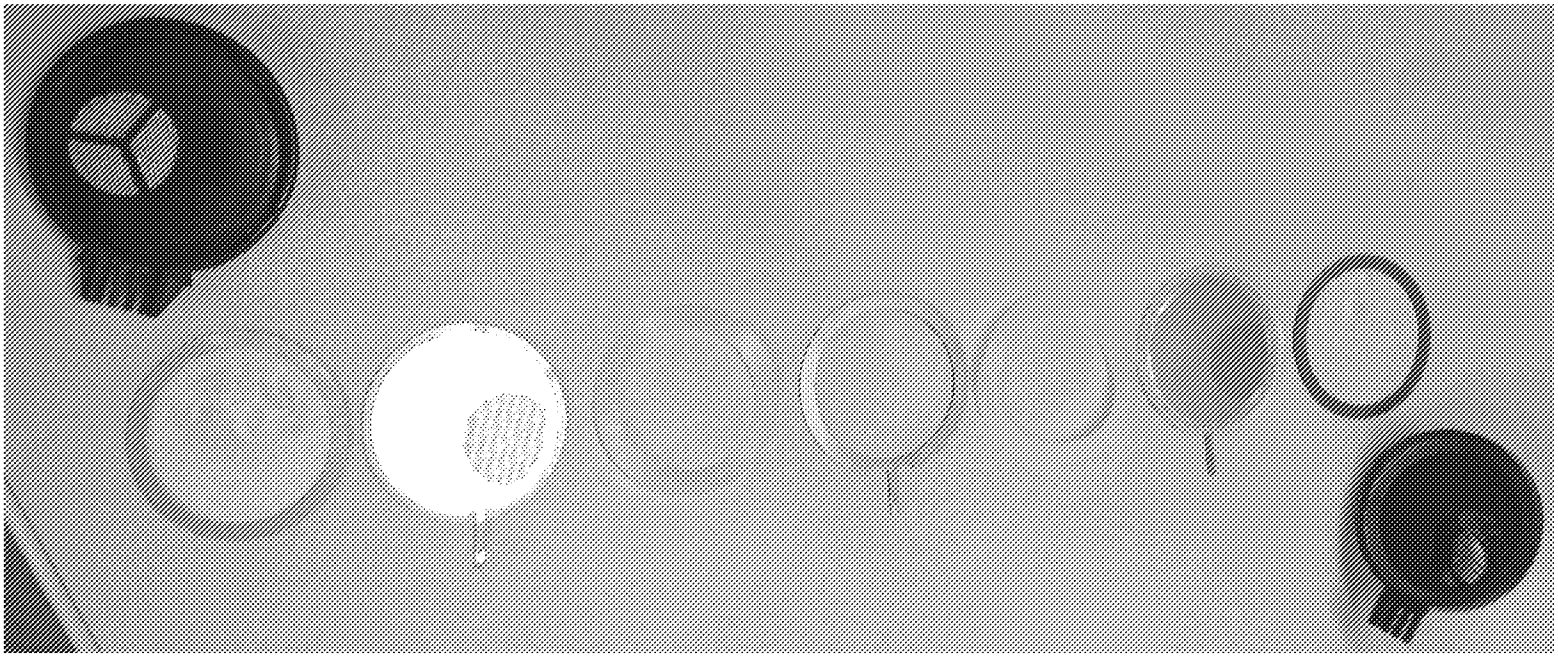
FIG. 25 shows a full disassembled traditional electrostatic transducing device.
Figure 26:
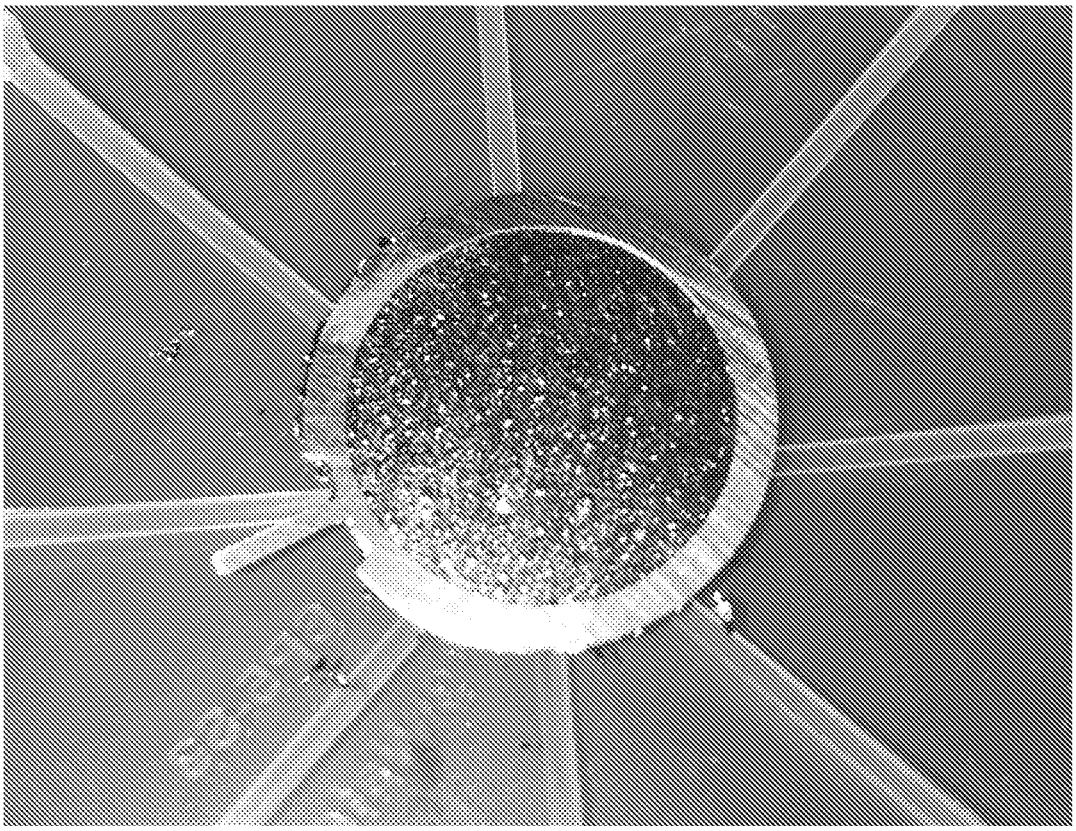
FIG. 26 shows a specially fabricated graphene diaphragm to replace the standard product diaphragm.
Figure 27:
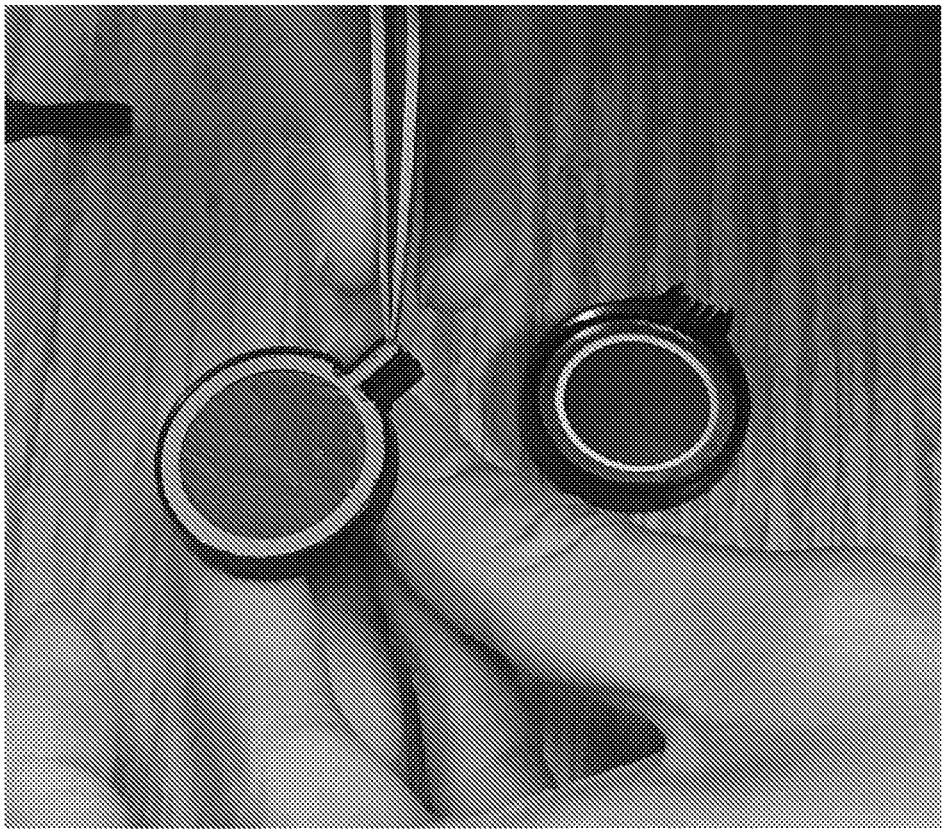
FIG. 27 shows re-assembly of the transducing device with the Graphene diaphragm for direct comparison of the diaphragm performance.
Figure 28:
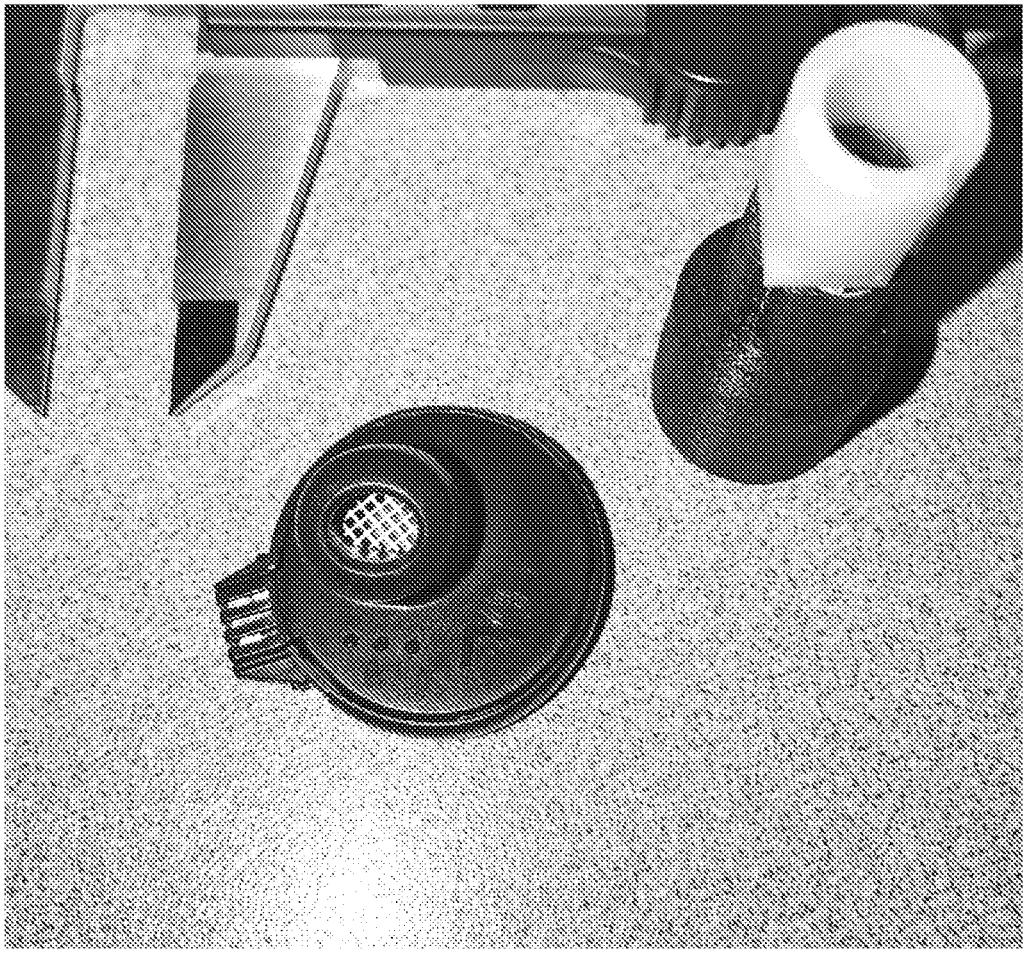
FIG. 28 shows an assembled transducing device containing a graphene diaphragm.
Figure 29:
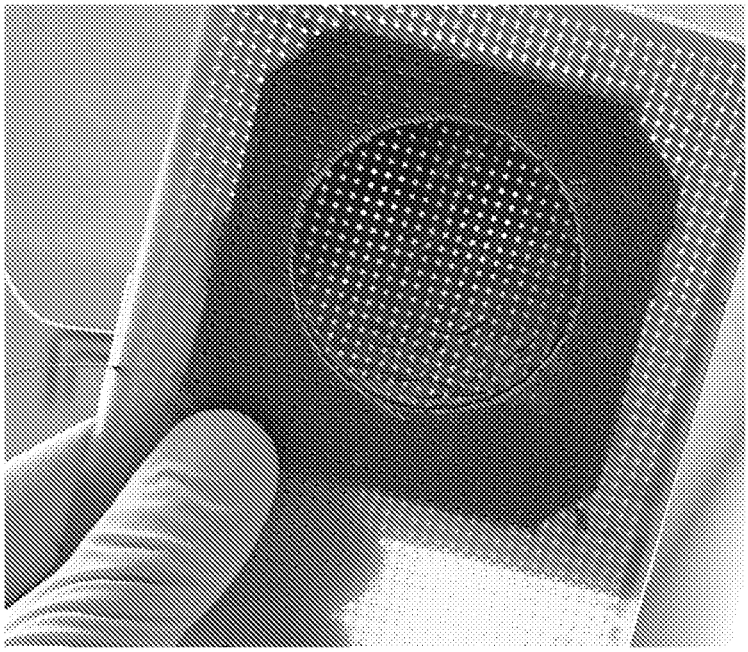
FIG. 29 shows a 50 mm graphene diaphragm in fabrication.
Figure 30:
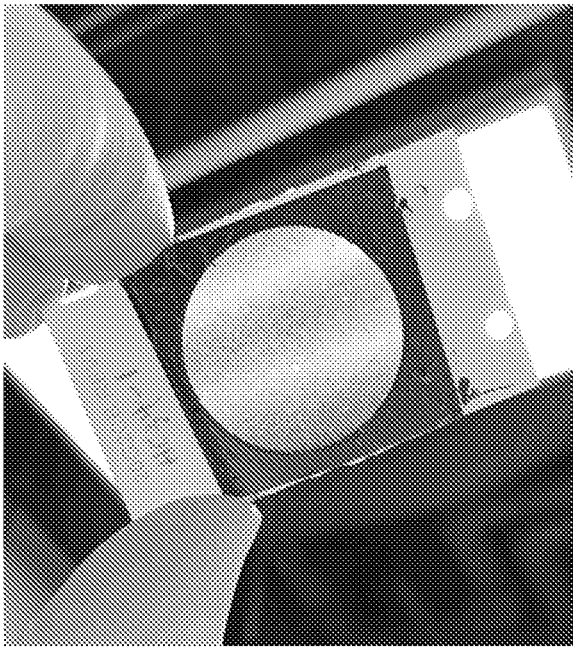
FIG. 30 shows a 28 mm graphene diaphragm suspension on a transfer board.

FIG. 25 shows the configuration of a more traditional electrostatic speaker which is not a permanent integrated transducer assembly. This method was used to validate the viability of the new diaphragm structures but is not a suitable vehicle for the ultra-thin film devices of this invention since it does not provide adequate protection for the diaphragm. Transducers built in this manner worked well if treated with care but could not survive standard product drop tests. Early HVM testing shows that integrated assembly devices manufactured in this manner can pass these same types of testing. An additional draw back to the assembly is that it requires significant hand assembly making it difficult to mass produce. FIG. 26 shows a graphene diaphragm fixed to a ring structure which is compatible with the traditional electrostatic speaker. FIG. 27 shows hand assembly of the traditional electrostatic speaker with the graphene diaphragm in place of the traditional diaphragm. FIG. 28 shows the fully assembled traditional electrostatic speaker with the graphene diaphragm inside in place of the traditional diaphragm.

In another embodiment, the open "transducing" size for each audio transducer can be as small as 1 mm diameter for full audio spectrum response from 20 Hz up to approximately 20 kHz. In another embodiment, for ultrasonic transducers, the size can be as small as 40 micron diameter for ultrasonic spectral response from 20 kHz up to approximately 0.5 MHz. Small audio transducers are well-suited for applications such as hearing aids and the like, where lower SPL (sound pressure loudness) is acceptable because the audio signal is channeled directly into the ear canal. The gap between electrode and diaphragm can be made smaller as diaphragm size is reduced, which increases the electric field between electrode and diaphragm (and therefore increases the force applied to the diaphragm), thus driving the transducer harder for a given applied voltage. Significantly larger diaphragm and gap sizes are possible since graphene growth and transducer packaging processes described herein are scalable. As a practical matter, larger diaphragm suspensions require larger gaps, and thus require higher voltages to generate the same sound output as compared to a devices with smaller gaps.

In one embodiment of the present invention, gaps of 500 um are used with diaphragm suspensions of 20 mm diameter, maximum DC voltages of 580 VDC, and maximum AC voltages of 230 Vrms. In certain embodiments, voltage requirements increase with gap size so that, as an approximation, a 40 mm diameter transducer may require a 1 mm gap on each side of the diaphragm, which in turn could require approximately 1.5 kV to operate. Larger gaps are typically needed for lower-frequency signals since larger diaphragm excursions occur as signal frequency decreases. As a result, another embodiment of the present invention is to use the graphene-based transducer as a mid-range and tweeter speaker, where smaller gaps can be used, while a more conventional speaker would be used as a sub-woofer to cover the low end of the audio spectrum. In this case, the bandwidth of the graphene-based transducer is limited to the higher frequency band using a cross-over network. Accordingly, the subject matter of the present application may be used to produce transducers which could be utilized well beyond the size expected for a microspeaker and into the manufacture of desktop and then room speakers.

The foregoing description of preferred embodiments has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

REFERENCE NUMERALS

A transducer array
D1 diaphragm
D2 diaphragm
D3 diaphragm
E1 electrode layer
E2 electrode layer
G glue
G1 gap
G2 gap
S1 spacer layer
S2 spacer layer
1 active transduction area
2 additional layers on graphene diaphragm
3 photo-sensitive material
4 exposed photo-sensitive material
5 unexposed photo-sensitive material
6 light source
7 mask
8 holes
9 interconnect
10 stand-off layer
11 outer perimeter of diaphragm
12 exposed graphene region
13 surface
14 inner side of electrode layers
15 openings in electrodes
16 dielectric layer of electrodes layers
17 conductive layer of electrode layers
18 second dielectric layer of electrode layers
19 epoxy layer of spacer layers
20 dielectric layer of spacer layers
21 conductive layer of spacer layers
22 interconnect conductive materials
23 interconnect dielectric materials
24 sacrificial film or structure

The invention claimed is:

1. An electrostatic transducer comprising:

a diaphragm comprising a 2-D material;

a first spacer that is in large round, sheet, or roll form having patterning for many devices onto which one side of the diaphragm is bonded;

a second spacer that is in large round, sheet, or roll form having patterning for many devices, which is bonded to the other side of the diaphragm, wherein the first and second spacer both bound substantially circular open regions that define a substantially circular portion above and below the diaphragm;

a first electrode that is in a large round, sheet or roll format with patterning for many devices, which is proximate one side of the circular portion of the diaphragm and the first spacer;

a second electrode that is in a large round, sheet or roll format with patterning for many devices, which is proximate the other side of the circular portion of the diaphragm and the second spacer.

2. The electrostatic transducer of claim 1, wherein the diaphragm comprising a 2-D material is an atomically single or multilayer graphene film.

3. The electrostatic transducer of claim 1, wherein the diaphragm comprising a 2-D material is selected from the group consisting of h-BN, $MoS_2$, and a bilayer film comprising atomically single or multilayer graphene and h-BN, $MoS_2$, or another single layer 2-D film.

4. The electrostatic transducer of claim 1, further comprising:

a plurality of patterned electrically conductive interconnects to external acoustic electrical signal comprising one lead for each of the first and second electrodes and one lead arranged on a part of or around the entire circumference of diaphragm; and electrical circuitry connected to the plurality of patterned electrically conductive having the capability for signal sensing or for applying audio or ultrasonic signals to the electrodes to modulate the diaphragm and emit acoustic waves.

5. The electrostatic transducer of claim 1, wherein the diaphragm has an open active transducer area, wherein the open active transducer area is of circular, elliptical, square, rectangular, rounded rectangular, kidney or of another irregular shape.

6. The electrostatic transducer of claim 1, wherein the transducer operates at the following gap distances and voltages:

a diaphragm to electrode gap between approximately 0.1 mm and approximately 1 mm;

a $V_{DC}$ on the diaphragm of between approximately 20V and approximately 4 kV;

a $V_{signal}$ on the first and second electrodes of $V_{RMS}$ between approximately 20V and approximately 4 kV.

7. The electrostatic transducer of claim 6, wherein the transducer operates at the following gap distances and voltages:

a diaphragm to electrode gap of approximately 1 mm;

a $V_{DC}$ on the diaphragm of approximately 4 kV;

a $V_{signal}$ on the electrodes of $V_{RMS}$ of approximately 4 kV.

8. The electrostatic transducer of claim 6, wherein the transducer operates at the following gap distances and voltages:

a diaphragm to electrode gap of 0.1 mm;

a $V_{DC}$ on the diaphragm of up to 20V;

a $V_{signal}$ on the first and second electrodes of $V_{RMS}$ of 20V.

9. The electrostatic transducer of claim 2, further comprising an acrylic, polyester, silicone, polyurethane, or halogenated plastic layer formed on one or both sides of the diaphragm to substantially cover the graphene surface, wherein the layer can be continuous to cover the entire graphene surface or the layer is patterned and removed from central regions of the graphene surface so that it remains only along an outer perimeter of the diaphragm to provide additional mechanical strength where the diaphragm is clamped along the perimeter.

10. The electrostatic transducer of claim 2, further comprising covering layer comprising a silicon dioxide, aluminum oxide, silicon nitride or diamond and/or diamond-like layer formed on one or both sides of the graphene film, wherein the covering layer substantially covers an upper and/or a lower surface of the graphene film.

11. The electrostatic transducer of claim 10, wherein the covering layer is patterned and removed from central regions of the graphene film so that the covering layer remains only along an outer perimeter of the graphene film to provide additional mechanical strength where the graphene film is clamped along the perimeter.

12. The electrostatic transducer of claim 2, further comprising a photo-active layer such as photoresist formed on one or both sides of the diaphragm to substantially cover the graphene surface, wherein the layer can be selectively removed in any desired pattern to tune, enhance or modulate a diaphragm excursion profile in response to applied electrostatic forces.

13. The electrostatic transducer of claim 10, wherein the photo-active layer such as photoresist is formed on one or both sides of the diaphragm to substantially cover the graphene surface, wherein both the photoresist layer and the graphene can be selectively removed in any desired pattern to tune, enhance or modulate the diaphragm's excursion profile in response to applied electrostatic forces.

14. The electrostatic transducer of claim 1, further comprising in-plane layered device contacts electrically connected to pre-routed electrode or spacer components.

15. An array comprising a plurality of electrostatic transducers as recited in claim 1, wherein the plurality of electrostatic transducers are arranged in a custom array or an as-fabricated contiguous multiplex array of devices.

16. The array of claim 15, wherein the plurality of electrostatic transducers are electrically connected and function as either a mono-speaker or large area microphone.

17. The array of claim 15, wherein the plurality of electrostatic transducers are electrically connected such that individual or clusters of speakers can be multiplexed and used as different speaker channels and microphones simultaneously.

18. A method for manufacturing an electrostatic transducer according to claim 1, comprising:

providing a first multilayer construction comprising first electrode and first spacer component, a diaphragm comprising a 2-D material, and a second multilayer construction comprising second electrode and second spacer component;

subsequently aligning and attaching the diaphragm to the first multilayer construction using a first adhesive; and aligning and attaching the second multilayer construction to the diaphragm using a second adhesive.

19. The method of claim 18, wherein the 2-D material comprises atomically single or multilayer graphene.

20. The method of claim 19, wherein at least the first adhesive or the second adhesive permits an electric current to cross the adhesive and pass to the diaphragm.

21. The method of claim 19, wherein aligning and attaching the diaphragm to the first multilayer construction is performed using a transfer board.

22. The method of claim 20, wherein prior to attaching the graphene, patterning an additional thin layer of a material other than graphene on the graphene of the diaphragm, wherein the additional thin layer is patterned such that it is located (a) only along an outer perimeter of the diaphragm, (b) to create a desired displacement pattern across the diaphragm surface to essentially tune or enhance the diaphragm's excursion profile in response to applied electrostatic forces, or (c) to allow selective removal of graphene in some regions to form a desired pattern of holes in the diaphragm.

23. The method of claim 22, wherein patterning utilizes a technique selected from the group consisting of photolithography, shadow-mask, lift-off, polishing, ink-jet printing, 3D-printing, or screen-printing.

24. The method of claim 23, wherein the diaphragm is provided with a sacrificial layer which is removed after the diaphragm is aligned and attached.

* * * * *